US006742611B1

(12) United States Patent
Illerhaus et al.

(10) Patent No.: US 6,742,611 B1
(45) Date of Patent: Jun. 1, 2004

(54) LAMINATED AND COMPOSITE IMPREGNATED CUTTING STRUCTURES FOR DRILL BITS

(75) Inventors: Roland Illerhaus, The Woodlands, TX (US); Gordon A. Tibbitts, Salt Lake City, UT (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/583,241

(22) Filed: May 30, 2000

Related U.S. Application Data

(63) Continuation-in-part of application No. 09/154,383, filed on Sep. 16, 1998, now Pat. No. 6,241,036.

(51) Int. Cl.[7] ..... E21B 10/36
(52) U.S. Cl. ..... 175/433; 175/434
(58) Field of Search ..... 175/434, 433, 175/428

(56) References Cited

U.S. PATENT DOCUMENTS

| | | | |
|---|---|---|---|
| 2,326,908 | A | 8/1943 | Williams, Jr. |
| 2,371,489 | A | 3/1945 | Williams, Jr. |
| 2,582,231 | A | 1/1952 | Catallo |
| 3,106,973 | A | 10/1963 | Christensen |
| 3,537,538 | A | 11/1970 | Generoux |

(List continued on next page.)

FOREIGN PATENT DOCUMENTS

| | | |
|---|---|---|
| DE | 3347501 A1 | 9/1985 |
| EP | 0 029 535 | 11/1980 |
| EP | 0 284 579 | 3/1988 |
| EP | 0 356 097 | 8/1989 |
| EP | 0 601 840 | 12/1993 |
| GB | 2328233 A | 2/1999 |
| SU | 632-823 | 11/1978 |
| WO | WO 00/15942 | 3/2000 |

OTHER PUBLICATIONS

European Search Report dated Jun. 5, 2003.
Search Report of Aug. 6, 2001 from UK Patent Application No. 0111598.9.

*Primary Examiner*—Hoang Dang
(74) *Attorney, Agent, or Firm*—TraskBritt

(57) ABSTRACT

A laminated cutting element for use on a rotary-type earth-boring drill bit for drilling subterranean formations preferably including at least one first segment formed of a hard, continuous-phase material impregnated with a particulate superabrasive material laminated to and including at least one second segment formed of a continuous-phase material having essentially no particulate superabrasive material impregnated therein. Alternatively, the at least one second segment may have superabrasive and/or abrasive material impregnated therein which is less abrasive than the superabrasive material impregnated in the at least one first segment. Preferably, the continuous-phase material in which the at least one first segment and the at least one second segment are made is a metal matrix material.

A further alternative of the present invention includes a single segment formed of a continuous-phase material in which a particulate superabrasive material is impregnated. The alternative single segment has a relatively thin cross-sectional thickness and is securable to a support member preferably fabricated from a tough and ductile material. The support member further includes a bit attachment portion securable to a bit body and a segment-receiving portion adapted to receive and support the superabrasive impregnated segment during drilling.

A yet further alternative of the present invention includes a composite segment formed of a continuous-phase material wherein a preselected portion of the segment is impregnated with a particulate superabrasive material.

93 Claims, 27 Drawing Sheets

U.S. PATENT DOCUMENTS 3,709,308 A 1/1973 Rowley et al.
3,800,891 A 4/1974 White et al.
3,841,852 A 10/1974 Wilder et al.
3,871,840 A 3/1975 Wilder et al.
3,885,637 A 5/1975 Veprintsev et al.
3,938,599 A 2/1976 Horn
4,098,362 A 7/1978 Bonnice
4,128,136 A 12/1978 Generoux
4,176,723 A 12/1979 Arceneaux
4,234,048 A 11/1980 Rowley
4,255,165 A 3/1981 Dennis et al.
4,274,769 A 6/1981 Multakh
4,274,840 A 6/1981 Housman
4,333,540 A 6/1982 Daniels et al.
4,465,148 A 8/1984 Morris et al.
4,525,178 A 6/1985 Hall
4,570,725 A 2/1986 Matthias et al.
4,592,433 A 6/1986 Dennis
4,604,106 A 8/1986 Hall
4,629,373 A 12/1986 Hall
RE32,380 E 3/1987 Wentorf, Jr. et al.
4,670,025 A 6/1987 Pipkin
4,686,080 A 8/1987 Hara et al.
4,719,979 A 1/1988 Jones
4,726,718 A 2/1988 Meskin et al.
4,844,185 A 7/1989 Newton, Jr. et al.
4,861,350 A 8/1989 Phaal et al.
4,877,096 A 10/1989 Tibbitts
4,889,017 A 12/1989 Fuller et al.
4,898,252 A 2/1990 Barr
4,902,652 A 2/1990 Kume et al.
4,940,180 A 7/1990 Martell
4,943,488 A 7/1990 Sung et al.
4,990,403 A 2/1991 Ito
4,991,670 A 2/1991 Fuller et al.
5,025,871 A 6/1991 Stewart et al.
5,049,164 A 9/1991 Horton et al.
5,090,491 A 2/1992 Tibbitts et al.
5,099,935 A 3/1992 Anthon et al.
5,103,922 A 4/1992 Jones
5,135,061 A * 8/1992 Newton, Jr. ..... 175/379
5,147,001 A * 9/1992 Chow et al. ..... 175/428
5,158,148 A 10/1992 Keshavan
5,205,684 A * 4/1993 Meskin et al. ..... 175/374
5,217,081 A * 6/1993 Waldenstrom et al. ... 175/420.2
5,238,074 A 8/1993 Tibbitts et al.
5,279,375 A 1/1994 Tibbitts et al.
5,282,513 A 2/1994 Jones
5,348,108 A 9/1994 Scott et al.
5,355,750 A 10/1994 Scott et al.
5,413,772 A 5/1995 Pinneo
5,431,239 A 7/1995 Tibbitts et al.
5,460,233 A 10/1995 Meany et al.
5,505,272 A 4/1996 Clark
5,533,582 A 7/1996 Tibbitts
5,560,440 A 10/1996 Tibbitts
5,564,511 A 10/1996 Frushour
5,566,779 A 10/1996 Dennis
5,590,729 A 1/1997 Cooley et al.
5,592,995 A 1/1997 Scott et al.
5,732,783 A 3/1998 Truax et al.
5,743,346 A 4/1998 Flood et al.
5,788,001 A 8/1998 Matthias et al.
5,829,541 A 11/1998 Flood et al.
5,836,409 A 11/1998 Vail, III
5,928,071 A 7/1999 Devlin
5,979,578 A 11/1999 Packer
6,009,962 A 1/2000 Beaton
6,039,641 A * 3/2000 Sung ..... 125/22
6,073,518 A 6/2000 Chow et al.
6,095,265 A * 8/2000 Alsup ..... 175/379
6,102,140 A * 8/2000 Boyce et al. ..... 175/374
6,241,036 B1 6/2001 Lovato et al.

* cited by examiner

LAMINATED AND COMPOSITE IMPREGNATED CUTTING STRUCTURES FOR DRILL BITS

CROSS REFERENCE TO RELATED APPLICATION

This is a continuation-in-part of application Ser. No. 09/154,383, filed Sep. 16, 1998, now U.S. Pat. No. 6,241,036 B1, issued Jun. 5, 2001.

BACKGROUND OF THE INVENTION

1. Field of the Invention

The present invention relates generally to cutting elements for use on earth-boring drill bits and bits so equipped. In particular, the present invention relates to cutting elements having abrasive particles impregnated in a matrix. More specifically, the cutting elements of the present invention may include a tough and ductile support structure which may be internal or external to the impregnated segment. Yet more specifically, cutting elements, and segments, embodying the present invention may be arranged in preselected arrays, or patterns, and orientations to enhance drilling efficiency.

2. Background of Related Art

Conventionally, earth-boring drill bits with impregnated cutting structures, commonly termed "segments," have been employed to bore through hard and abrasive formations, such as basalt, dolomite and hard sandstone. As depicted by FIG. 1, the impregnated segments 16 of such drill bits are typically secured to the boring end 14, which is typically termed the "face," of the bit body 12 of the drill bit 10 in a generally radial fashion. Impregnated segments may also be disposed concentrically over the face of the drill bit. As the drill bit gradually grinds through a very hard and abrasive formation, the outermost layer of the impregnated segments containing abrasive particles (such as small diamonds, diamond grit, or other superabrasive particles such as cubic boron nitride) wear and may fracture. Many conventional impregnated segments are designed to release, or "shed," such diamonds or grit in a controlled manner during use of the drill bit. As a layer of diamonds or grit is shed from the face, underlying diamonds are exposed as abrasive cuttings and the diamonds that have been shed from the drill bit wear away the exposed continuous phase of the segment in which the interior diamonds are dispersed, thereby "resharpening" the bit until the entire diamond-impregnated portion of the bit has been consumed. Thus, drill bits with diamond-impregnated segments typically maintain a substantially constant boring rate as long as diamonds remain exposed on such segments.

Conventional impregnated segments typically carry the superabrasive particles in a continuous phase of a hard material, such as tungsten carbide, a tungsten alloy, a metal carbide, a refractory metal alloy, a ceramic, copper, a copper-based alloy, nickel, a nickel-based alloy, cobalt, a cobalt-based alloy, iron, an iron-based alloy, silver, or a silver-based alloy. Such materials are, however, typically relatively brittle and may fracture when subjected to the stresses of drilling. Accordingly, when subjected to the high stresses of drilling, and particularly impact stresses, the continuous phase of such impregnated segments may break, resulting in the premature failure thereof and potentially the premature failure of the bit upon which such segments are carried. Thus, drilling times and costs are increased by premature failure of conventional impregnated segments, as it is necessary to remove the drill string from the bore hole, replace the entire drill bit, and reintroduce the drill string into the bore hole.

U.S. Pat. No. 4,234,048 (the "'048 patent"), which issued to David S. Rowley on Nov. 18, 1980, discloses an exemplary drill bit that bears diamond-impregnated segments on the crown thereof. Typically, the impregnated segments of such drill bits are C-shaped or hemispherically shaped, somewhat flat, and arranged somewhat radially around the crown of the drill bit. Each impregnated segment typically extends from the inner cone of the drill bit, over the nose and up the bit face to the gage. The impregnated segments may be attached directly to the drill bit during fabrication or partially disposed within a slot or channel formed into the crown and secured to the drill bit by brazing. When attached to the crown of a drill bit, conventional impregnated segments have a relatively low profile (i.e., shallow recesses between adjacent segments) relative to the bit face and a footprint that covers the majority of the drill bit surface from the nose to the gage. The low profile is typically required due to the relatively brittle materials from which the continuous phases of conventional impregnated segments are formed. Similarly, the generally semicircular shape of conventional impregnated segments and their somewhat radial arrangement around the crown of a bit body are required to prevent the breakage and premature wear of such impregnated segments due to the hard but relatively brittle continuous-phase materials thereof. The large "footprint" of conventional impregnated segment-bearing drill bits is typically necessary to provide a sufficient amount of cutting material on the face of the bit. To some extent, the conventionally required semicircular shape of impregnated segments has also prohibited the use of alternative impregnated segment shapes, drill bit designs, and arrangements of impregnated segments on drill bits, which could otherwise optimize drilling rates and reduce the rate of bit wear and failure.

Because of the low profile or exposure and large surface area footprint of conventional impregnated segments, very little clearance exists between the face of the drill bit and the drilled formation during use of the drill bit upon which such segments are carried. Consequently, the build-up of formation fines, frequently referred to as rock flour, on the impregnated segments may prevent contact of the impregnated segments with the interior surface of the borehole and may reduce the depth of cut of the drill bit.

Moreover, due to the large surface area footprint and the low profile of impregnated segments on conventional drill bits, the hydraulics of such drill bits cannot be fully employed to remove formation fines therefrom or to cool the segments. Therefore, the penetration rate of drilling and the amount of weight on bit that may be employed on the drill bit may both decrease, while the rate of wear will be undesirably high, and failure of the drill bit may occur.

An additional characteristic with conventional impregnated segments having large surface area footprints is that much of the exposed cutting surface of the segments is located a significant lateral distance from the nearest waterway, or area in which drilling-fluid is circulated. Such relatively large lateral distances from the flow of water or drilling fluid thereby impedes the flushing away of cuttings, or fines, from the segment and can aggravate the previously mentioned problems such as the face and crown of the drill bit being built up with sands and fines.

Another problem encountered in the art is that when drilling differing formations or when drilling a formation having soft layers, medium hard layers, and hard layers, it is usually necessary to employ drill bits particularly designed and especially suited for drilling in the layer being encountered in order to ensure steady progress on the well being drilled. Thus, a drilling crew is frequently selecting a drill bit having an appropriate diamond cutter density to balance the rate of penetration (ROP) with wear resistance for extending the useful life of the bit. For example, upon encountering a relatively soft layer, a relatively economical drill bit having a light diamond cutter density particularly suited to drilling soft layers would be used to maximize the rate of bit penetration in the formation. Upon encountering a medium hard layer, a relatively more expensive drill bit having a medium cutter density particularly suited to drilling medium hard layers would be required to maximize the rate of bit penetration in that particular medium hard strata of the formation being drilled. Lastly, upon encountering a hard layer, a yet more expensive drill bit having a high diamond cutter density particularly suited to drilling hard layers would be required to prevent excessive wear of the cutters while allowing a sufficient weight-on-bit that would provide an acceptable ROP through such hard portion of the formation being drilled. Thus, it would be desirable to have a bit that could drill quickly through soft layers and medium layers of a given formation and that could also drill the hard layers of the formation at an acceptable ROP while also providing enhanced wear resistance to extend the useful life of the bit. Such a drill bit would economically benefit the art by decreasing the amount of rig time required to pull a particular drill bit from the well bore being drilled, substitute it with another drill bit more suitable for the particular layer being drilled, and then run the substitute drill bit into the well bore to resume drilling. During the drilling of a well, and depending on the total depth of the well and the number of various hard, medium, and soft layers that a well bore is to pass through until reaching the deepest or most distant zone of interest, several if not many such drill bit substitutions may be required, thereby significantly increasing the overall cost of drilling a well.

U.S. Pat. No. 5,505,272 issued to Ian E. Clark on Apr. 9, 1996, discloses a coring drill bit having cutting inserts made of segments cut from a composite blank wherein a polycrystalline diamond compact (PDC), or, alternatively, polycrystalline cubic boron nitride (PCBN), has been bonded to a tungsten carbide backing. The cut segments are then installed singularly or optionally arranged in clusters of three wherein the PDC or PCBN compact layer of each adjacent segment is differently oriented so as to be exposed to the leading face, the inner gage, or the outer gage, respectively. Additionally, a noncoring drill bit is disclosed wherein inserts protrude slightly from the face of the drill bit and extend from the outer gauge of the face of the bit toward the center of the face and wherein the inner ends of the inserts are at different distances from the central axis of the drill bit.

U.S. Pat. No. 4,128,136 issued to Generoux on Dec. 5, 1978, discloses a diamond coring bit having an annular crown and inner and outer concentric side surfaces. The inner concentric side surface of the crown defines a hollow core in the annular crown of the bit for accommodating a core sample of a subterranean formation. The annular crown is formed from a plurality of radially oriented composite segments impregnated with diamonds radially and circumferentially spaced apart from each other by less abrasive spacer materials.

U.S. Pat. No. 3,106,973 issued to Christensen on Oct. 15, 1963, discloses a drill bit provided with circumferentially and radially spaced apart grooves having cutter blades secured therein. The cutter blades have diamond impregnated sections formed of a matrix of preselected materials.

U.S. Pat. No. 5,147,001 issued to Chow et al. on Sep. 15, 1992, discloses a cutting structure for a drill bit including a substantially planar array of cutting elements arranged in contiguous proximity interrupted by a plurality of discontinuities to minimize and localize residual thermally induced stresses.

Notwithstanding benefits and advantages offered by drill bits including cutting elements incorporating abrasive particles impregnated within matrices of various materials as disclosed in the preceding references, there remains a need within the art for drill bit cutting elements incorporating impregnated segments which will better resist breakage during drilling of very hard and abrasive formations, and which may be optimally designed and arranged upon a drill bit.

There is also a need for cutting elements incorporating impregnated segments which may be strategically arranged on a drill bit to facilitate the use of drill bit hydraulics to remove formation fines from the impregnated surfaces of the drill bit, thereby facilitating the use of alternative and more efficient drill bit designs.

Furthermore, there is a need within the art for a drill bit which can be used to efficiently drill hard, medium, and soft layers of a given formation, or formations, while maximizing the wear resistance of the bit.

A further need within the art is for a drill bit having cutting elements including impregnated segments which can be positioned to have enhanced exposure to waterways or drilling fluid flow paths and channels of the bit to promote better flushing of cutting debris and formation fines away from the area of the segment engaging the formation.

An additional need within the art is for the ability to easily and consistently construct drill bits having cutting elements incorporating impregnated segments therein in preselected patterns and orientations in order to optimize the performance of the drill bit.

Another need within the art is for cutting structure which incorporates segments of abrasive, impregnated, solid matrix material which can readily and consistently be produced in a variety of shapes and nominal thicknesses to best suit a wide variety of drill bits.

SUMMARY OF THE INVENTION

The earth-boring drill bits and cutting elements embodying the present invention address the foregoing needs.

The earth-boring drill bits and cutting elements of the present invention are particularly suitable for use with bladed-style drill bits as well as nonbladed drill bits. Preferably, at least one first cutting element segment formed of a continuous-phase solid matrix material impregnated with at least one particulate superabrasive material is juxtapositioned with at least one second cutting element segment formed of a continuous-phase solid matrix material to comprise a laminated cutting element. Preferably, the at least one second segment is essentially devoid of impregnated superabrasive or abrasive particles. Alternatively, the at least one second segment can be impregnated with a preselected, secondary, particulate superabrasive material which results in the at least one second segment being less abrasive and less wear resistant than the at least one first abrasive segment.

Such continuous-phase solid matrices particularly suitable for forming the first and second segments, and not regarded as being superabrasive, include the following: metal carbide, tungsten carbide, tungsten-based alloys, refractory metal alloys, ceramics, copper, copper-based alloys, nickel, nickel-based alloys, cobalt, cobalt-based alloys, iron, iron-based alloys, silver, and silver-based alloys, for example. Such particulate superabrasive materials particularly suitable for impregnation include: natural diamond, synthetic diamond, polycrystalline diamond compact, thermally stable polycrystalline diamond, and cubic boron nitride.

Preferably, the segments have a preselected nominal thickness that can be constant or nonconstant, ranging from a minimum thickness to a maximum thickness. Typically, the nominal thicknesses of the segments are less than approximately 0.5 inches (approximately 12.2 mm) and preferably do not exceed 0.15 inches (3.8 mm). The segments may have a variety of overall configurations including generally rectangular, generally arcuate, generally circular, generally semicircular, and generally serpentine. Furthermore, the segments are arranged in preselected patterns and orientations. Such patterns include at least one first abrasive segment alternating with at least one second, generally superabrasive-free, or lesser abrasive segment. Preferably, the segments are positioned in a preselected pattern extending in a generally radial manner from the longitudinal center of the drill bit toward the gage portion of the bit body or, in the case of being mounted on a blade structure, generally along a selected portion of the blade structure. Furthermore, the individual segments comprising a laminated cutting element can be oriented generally circumferentially, radially, or at an angle with respect to an imaginary reference line to provide a wide variety of cutting elements.

An alternative embodiment of the present invention includes a cutting element adapted for being secured to a blade structure of a bladed-style earth-boring drill bit. The cutting element includes at least one first segment having a preselected overall configuration and a preselected nominal thickness secured to at least one blade structure of a drill bit. For example, a given segment could have a thickness of approximately 0.13 inches (3.3 mm) through one region of the segment and a thickness of approximately 0.5 inches (12.7 mm) through another region of the same segment.

The at least one first segment of the cutting element is comprised of an essentially continuous-phase solid matrix of at least one material impregnated with at least one particulate superabrasive material in at least a portion thereof. Furthermore, the at least one first segment is preferably disposed onto the at least one blade structure in such a manner and orientation to expose at least one lengthwise-extending edge of the at least one first segment to the formation. Additionally, the at least one first segment is located at a preselected distance from, and at a preselected orientation with respect to, an imaginary reference line extending generally along the major axis, or center, of the at least one blade structure. Optionally, the cutting element may be provided with at least one second segment being essentially superabrasive-free and having at least one lengthwise edge exposed and positioned in an end-to-end manner with the at least one first segment. A yet further option includes the at least one second segment being impregnated with a selected particulate superabrasive material which results in the at least one second segment being less abrasive and less abrasion resistant than the at least one first abrasive segment.

Other advantages of the present invention will become apparent to those of ordinary skill in the art through a consideration of the ensuing description, the drawings and the appended claims.

BRIEF DESCRIPTION OF THE DRAWINGS

FIG. 27*b* shows an alternative embodiment wherein both segments are impregnated with superabrasive particles but one segment is less abrasive and less abrasion resistant than the other;

DETAILED DESCRIPTION OF THE PREFERRED EMBODIMENTS

Figure 2:
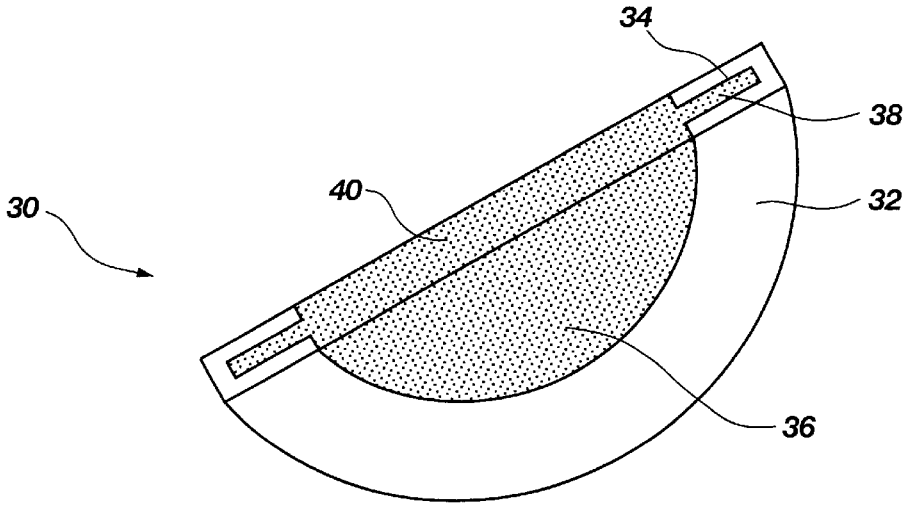
FIG. 2 is a perspective view of a first embodiment of a cutting element according to the present invention, including a C-shaped impregnated segment and a support member disposed in a concave portion of the impregnated segment.

With reference to FIG. 2, a first embodiment of a cutting element 30 according to the present invention is depicted. Cutting element 30 includes a substantially C-shaped impregnated segment 32 which defines a recess 34, which is also referred to as a member-securing portion or surface, in the concave portion thereof. Recess 34 is configured to receive a complementarily shaped segment-receiving portion 38 of a support member 36, which is also referred to as a member. A portion of support member 36 lying within the curve of the "C" of impregnated segment 32 is referred to as a bit attachment portion 40.

Impregnated segment 32 preferably includes a continuous phase, which may be a metallic phase, throughout which an abrasive, abrasion-resistant material is dispersed, as known in the art. Preferably, continuous-phase material is a hard, erosion-resistant and wear-resistant material. Continuous-phase materials that are useful in impregnated segment 32 include, without limitation, metal carbides (e.g., tungsten carbide, titanium carbide, silicon carbide, etc.), refractory metal alloys, ceramics, copper, copper-based alloys, nickel, nickel-based alloys, cobalt, cobalt-based alloys, iron, iron-based alloys, silver, or silver-based alloys.

Abrasive materials that are useful in impregnated segment 32 and provide a cutting structure within the segment are preferably hard, abrasive and abrasion-resistant materials. Exemplary abrasive materials with which the continuous-phase material of impregnated segment 32 may be impregnated include, but are not limited to, superabrasives, such as natural diamonds, synthetic diamonds, cubic boron nitride, as well as other hard, abrasive and abrasion-resistant materials. The abrasive material may be coated with a single layer or multiple layers of metal coatings, as known in the art and disclosed in U.S. Pat. Nos. 4,943,488 and 5,049,164, the disclosure of each of which is hereby incorporated by reference in its entirety. Such metal coatings are known to increase the strength with which the abrasive material bonds to the continuous-phase material. The abrasive material may be of a substantially uniform particle size, which may be measured in carats or mesh size, or may include particles of various sizes. Similarly, the continuous-phase material may be impregnated with a combination of various types of abrasive materials. Impregnated segment 32 may also include secondary abrasives, such as ceramics and aluminum oxides.

The continuous-phase material and abrasive material of impregnated segments 32 are preferably aggregated into a desired shape by known processes that bond the continuous-phase material and the particles of the abrasive material together, such as sintering, hot isostatic pressing, laser melting, or ion beam melting. Impregnated segment 32 may be fabricated with a recess or member-securing portion that is shaped to receive the segment-receiving portion 38 of support member 36 and subsequently secured thereto by known techniques, such as by the use of adhesives, brazing, or mechanical affixation. Alternatively, impregnated segment 32 may be formed directly onto support member 36 wherein impregnated segment 32 is simultaneously secured to support member 36.

Support member 36 is preferably fabricated from a tough and ductile material that will withstand the forces that are encountered by the drill bit while employed in the drilling of subterranean formations. Exemplary materials that may be used to fabricate support member 36 include, without limitation, iron, an iron-based alloy, nickel, a nickel-based alloy, copper, a copper-based alloy, titanium, a titanium-based alloy, zirconium, a zirconium-based alloy, silver, a silver-based alloy, and other tough and ductile materials that will withstand elevated temperatures, such as are experienced during sintering, brazing and bit furnacing. Support member 36 may be manufactured by techniques known in the art, such as by sintering, casting, forging or machining.

Figure 2A:
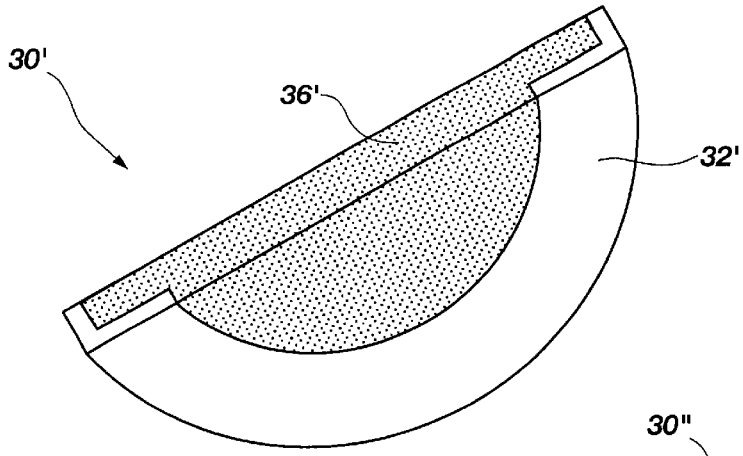
FIGS. 2*a*–2*c* are perspective views of variations of the cutting element of FIG. 2.
Figure 2B:
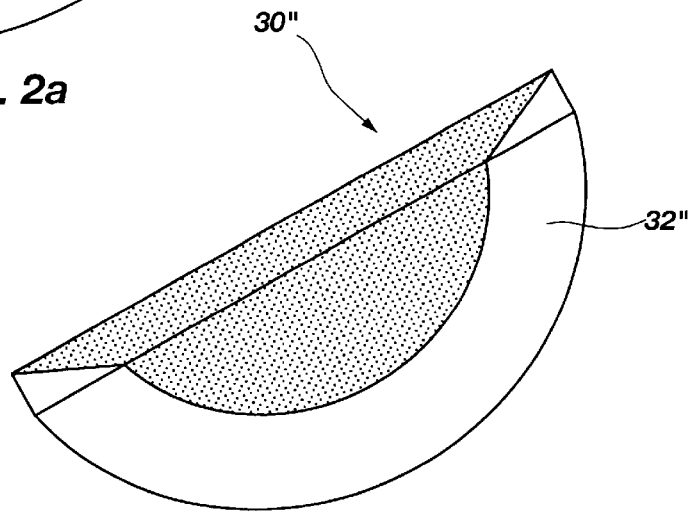
Figure 2C:
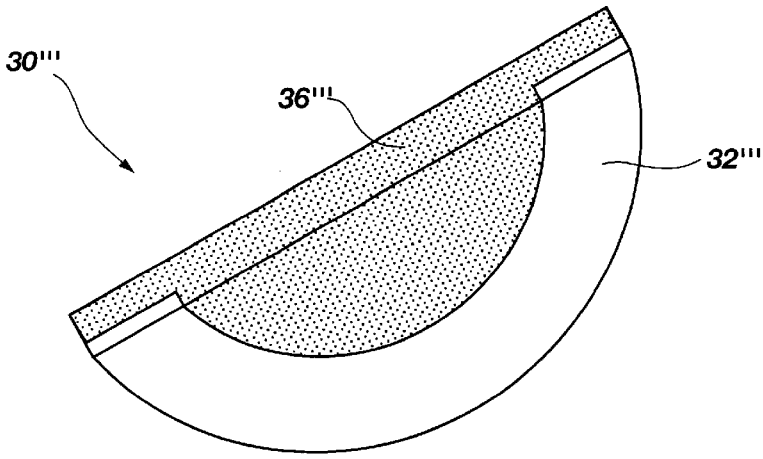

FIGS. 2*a*–2*c* illustrate exemplary variations of the cutting element 30 of FIG. 2 that are also within the scope of the present invention. FIG. 2*a* shows a cutting element 30' that includes an impregnated segment 32' having a C-shaped cross section. Preferably, when disposed on a drill bit, the portion of impregnated segment 32' that extends over the side of support member 36' faces in the same direction that the bit rotates. FIG. 2*b* shows a cutting element 30" including an impregnated segment 32" similar to that shown in FIG. 2*a*, but having a substantially triangular cross section. Again, the exposed side of impregnated segment 32" faces in the direction of bit rotation. FIG. 2*c* illustrates another variation in which the cutting element 30''' includes an impregnated segment 32''' that is secured to a single major surface of the support member 36'''.

Figure 3:
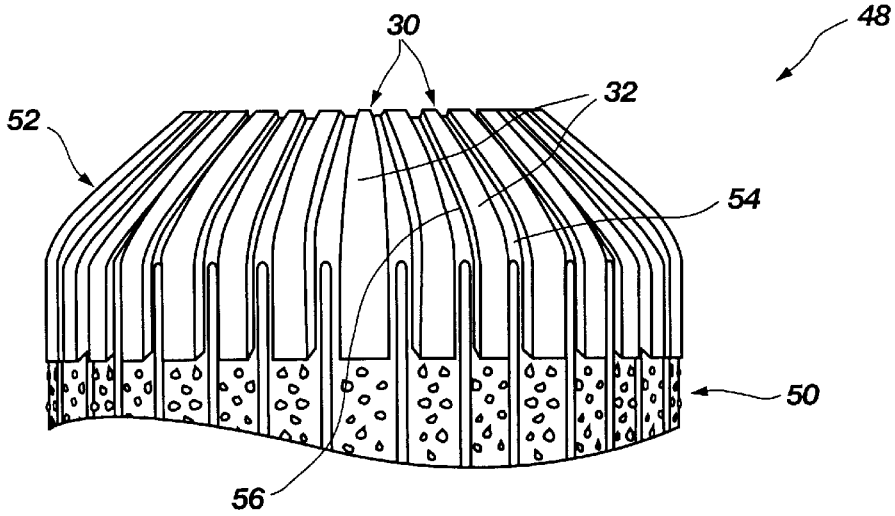
FIG. 3 is a partial inverted side plan view of a drill bit which includes the cutting elements of FIG. 2.

Referring to FIG. 3, a drill bit 48 is shown which includes several cutting elements 30 disposed in a generally radial fashion about the crown 52 of the bit 48. Preferably, the bit attachment portion 40 of the support member 36 (see FIG. 2) of each cutting element 30 is disposed within a slot 56 that is formed into crown 52 of drill bit 48 and shaped complementarily to bit attachment portion 40. Slots 56 may also be shaped to receive lower portions of impregnated segments 32, such that lower portions of impregnated segments 32 are recessed beneath and external to the bit face 54 so that the interfaces between impregnated segments 32 and support members 36 are protected from the drilling fluid and debris that are present in the bore hole during drilling.

The bit attachment portion 40 (see FIG. 2) of each cutting element 30 is secured to crown 52 by known techniques, such as by the use of adhesives, brazing, or mechanical affixation. Alternatively, and particularly when support member 36 is a particulate-based structure (e.g., a structure comprised of sintered steel), bit attachment portion 40 of each cutting element may be disposed within a mass of particulate-based matrix material used to form bit body 50, and the matrix material and support members integrally infiltrated, as known in the art. During infiltration, molten binder, typically a copper-based alloy, imbibes between the particles of the bit body 50 matrix and support member 36 by capillary action, by gravity, or under pressure. As the binder solidifies, it binds particles of the matrix to one another to form bit body 50 and fixes cutting elements 30 to bit body 50. As another alternative, a particulate-based support member 36 and its associated segment 32 may be infiltrated independently of the bit body, prior to assembly with or securing of same to crown 52.

Figure 1:
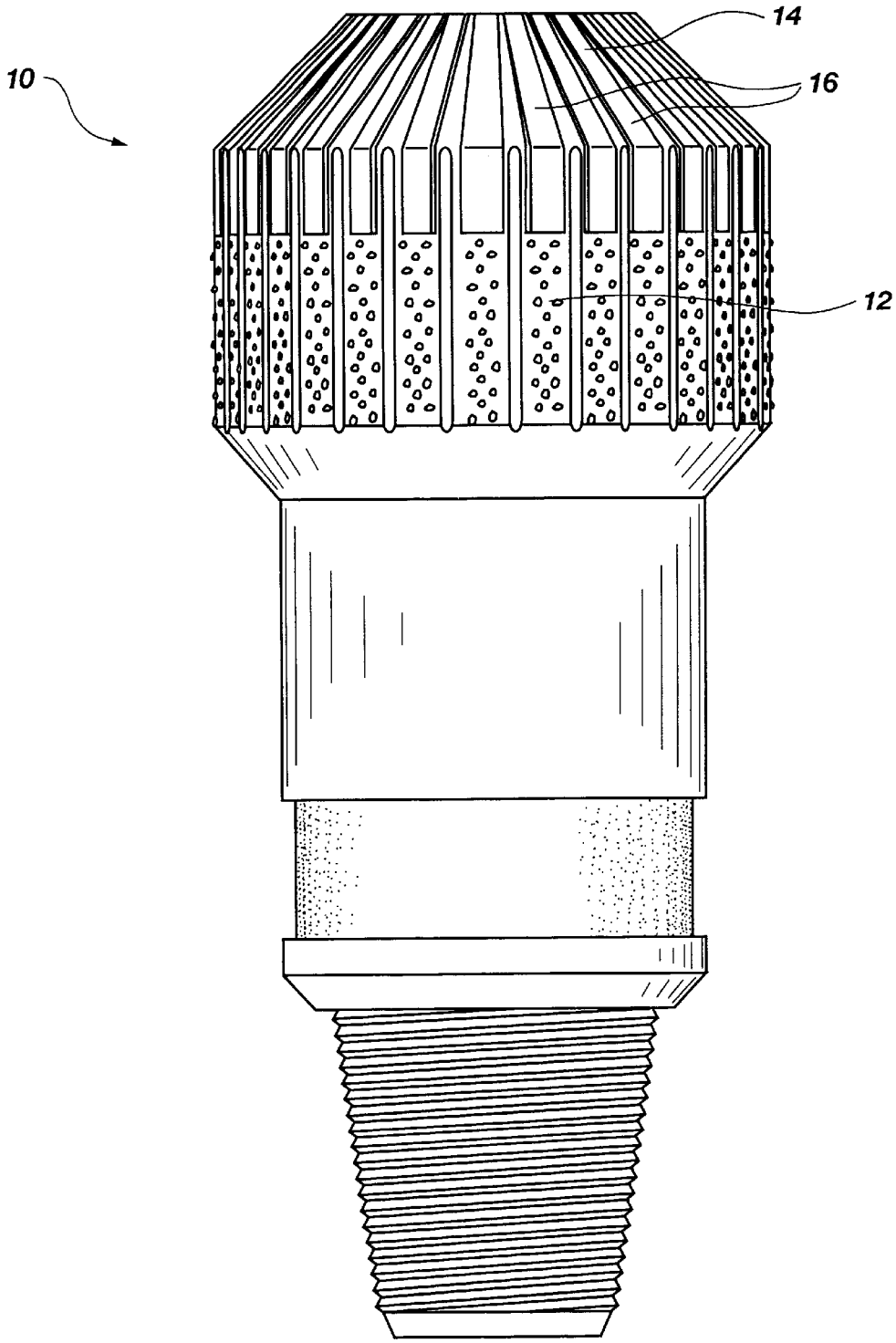
Fig. 1 (PRIOR ART)
FIG. 1 is an inverted side plan view of a conventional drill bit with impregnated segments disposed in a generally radial fashion over the crown thereof.

With continued reference to FIG. 3, due to the insertion of segment-receiving portion 38 of support member 36 into recess 34 (see FIG. 2) of impregnated segment 32, support member 36 braces and somewhat resiliently supports impregnated segment 32 against both normal and torsional rotational stresses encountered during drilling. Thus, support member 36 may reduce the likelihood that impregnated segment 32 will fracture or otherwise be damaged during drilling. Accordingly, support member 36 facilitates a higher profile or exposure of cutting elements 30 relative to bit face 54 than conventional drill bits that carry impregnated segments (see FIG. 1). Thus, a greater volume and depth of space may exist between adjacent cutting elements 30 on drill bit 48 than between conventional impregnated segments that are carried upon a similarly configured drill bit. This increased volume and depth of space between adjacent cutting elements 30 improves the hydraulic performance of drill bit 48 relative to conventional drill bits which carry impregnated segments. Consequently, cutting elements 30 facilitate an increased rate of debris removal from the drilling surface. Similarly, more drilling fluid may be supplied to the impregnated segments, which facilitates a reduction in the amount of potentially damaging friction generated at crown 52, as well as increases the rate at which the impregnated segments are cooled, reducing the likelihood of damaging the segments and potentially decreasing their rate of wear due to heat-induced degradation of the segment continuous-phase material.

Figure 4:
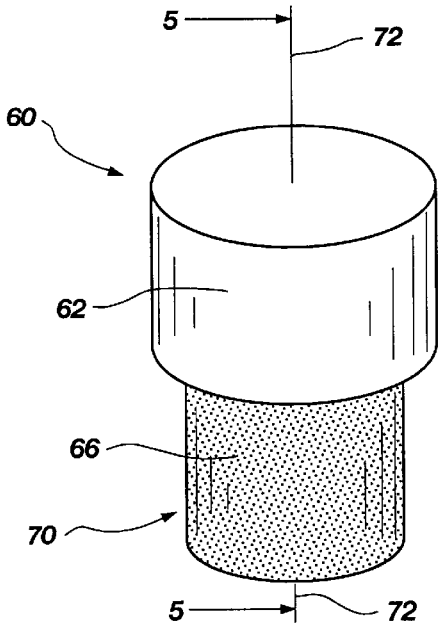
FIG. 4 is a frontal perspective view of another embodiment of the cutting element of the present invention, wherein the support member is an elongated member having an impregnated segment disposed on a portion thereof.
Figure 5:
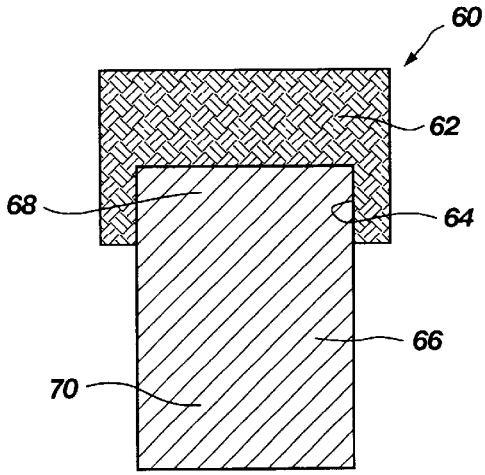
FIG. 5 is a cross-section taken along line 5—5 of FIG. 4.

FIGS. 4 and 5 illustrate another embodiment of the cutting element 60 of the present invention, which includes a post-like support member 66, which is also referred to as a member, with an impregnated segment 62 disposed on a portion thereof. Preferably, impregnated segment 62 is fabricated from a continuous-phase material that is impregnated with an abrasive material, such as the continuous-phase materials and abrasive materials described above in reference to the impregnated segment 32 of cutting element 30, shown in FIG. 2. The continuous-phase material and abrasive material of impregnated segment 62 may also be aggregated by known processes, such as sintering, hot isostatic pressing, laser melting, or ion beam melting. Impregnated segment 62 has a circular cross section, taken transverse to a longitudinal axis 72 of cutting element 60, and includes a receptacle 64 formed in a bottom surface thereof.

Support member 66 may be an elongated structure which includes a segment-receiving portion 68 at one end thereof and a bit attachment portion 70 at the opposite end thereof. Segment-receiving portion 68 is preferably shaped complementarily to receptacle 64 of impregnated segment 62 so that it may receive and secure the impregnated segment or impregnated segment 62 may be formed over support member 66. Support member 66 may be fabricated from the same material and processes that may be employed to fabricate support member 36, which is shown in FIG. 2. Similarly, known techniques, such as those described above in reference to FIG. 2, may be employed to secure impregnated segment 62 to support member 66.

Figure 6:
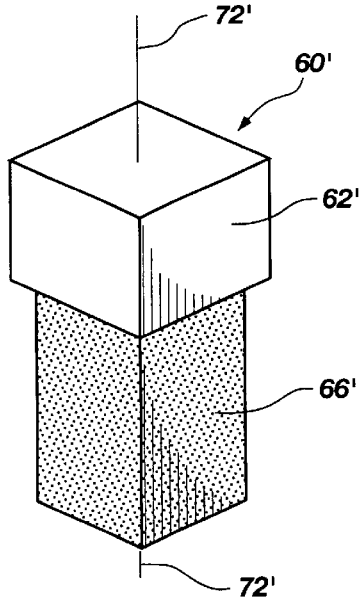
FIG. 6 is a perspective view of a variation of the cutting element of FIGS. 4 and 5, wherein the support member and impregnated segment each include a noncircular cross-section.

FIG. 6 illustrates a variation of the present embodiment of the cutting element 60', which includes a rectangularly shaped impregnated segment 62' attached to a portion of a support member 66' of rectangular cross section taken transverse to a longitudinal axis 72' of the cutting element. Similarly, the impregnated segments and support members of other variations of the present embodiment of the cutting element may have other, noncylindrical shapes.

Figure 7:
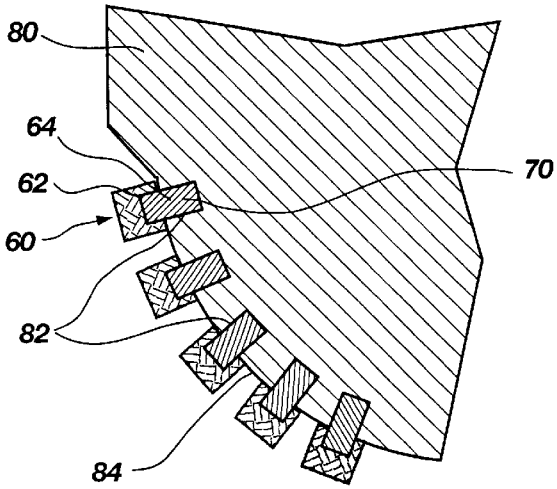
FIG. 7 is a partial vertical cross-sectional view of a bit body, which illustrates the support member of FIGS. 4 and 5 disposed in a socket of the bit body with the entire impregnated segment being located externally relative to the bit face.

As shown in FIG. 7, bit attachment portion 70 of support member 66 may be disposed within a socket 82 formed in a face 84 of a bit body 80 by similar techniques to those described above in reference to FIG. 3. Preferably, socket 82 is shaped complementarily to bit attachment portion 70 in order to receive cutting element 60 and securely attach same to bit body 80. In FIG. 7, cutting elements 60 are arranged on bit body face 84 such that impregnated segments 62 are located entirely external relative to the bit face, and the bottom surface of the impregnated segments may abut the bit face.

Figure 8:
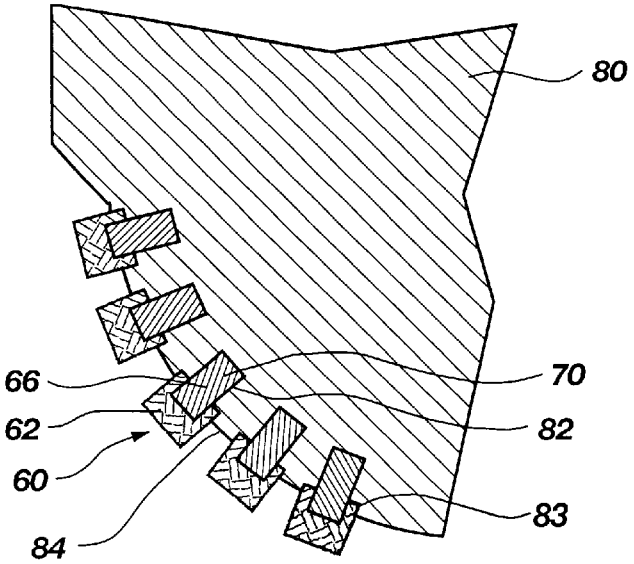
FIG. 8 is a partial vertical cross-sectional view of a bit body, which illustrates the support member of FIGS. 4 and 5 disposed in a socket of the bit body and a portion of the impregnated segment disposed in a countersink formed about the socket.

Alternatively, as shown in FIG. 8, each socket 82 may include a countersink 83 around the opening thereof, within which a lower portion of impregnated segment 62 may be disposed as a support member 66 is positioned within socket 82 and cutting element 60 is attached to bit body 80. When a portion of impregnated segments 62 is located below bit body face 84, the interface between impregnated segments 62 and support member 66 is shielded from the drilling surface, debris and drilling fluid that may otherwise penetrate the interface and dislocate impregnated segments 62 from support member 66 by erosion or abrasion.

Figure 9:
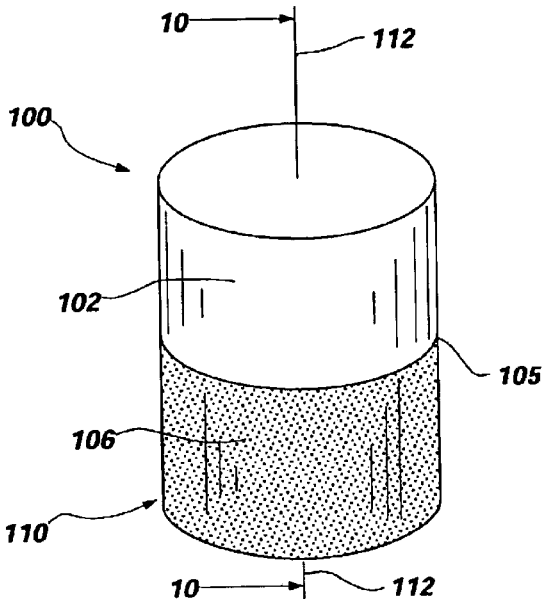
FIG. 9 is a frontal perspective view of another embodiment of the cutting element of the present invention, wherein the support member is an elongated member having an impregnated segment disposed on a portion thereof such that the periphery of the impregnated segment is substantially flush with the exposed periphery of the support member.
Figure 10:
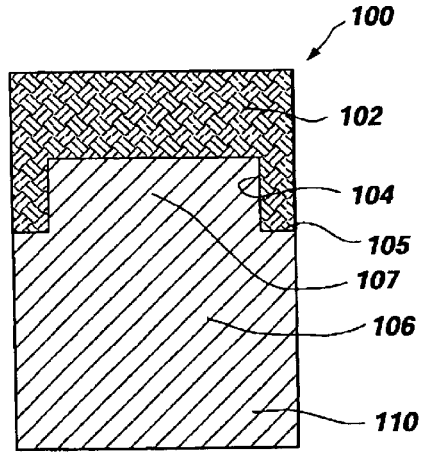
FIG. 10 is a cross-section taken along line 10—10 of FIG. 9.

Turning now to FIGS. 9 and 10, another embodiment of the inventive cutting element 100 is shown, which includes an impregnated segment 102 disposed on a portion of a support member 106. Impregnated segment 102 and support member 106 each have a circular cross section, taken transverse to a longitudinal axis 112 of cutting element 100. Impregnated segment 102 includes a recess 104, which is also referred to as a member-securing portion, formed in the bottom thereof, which is configured to interconnect with a complementarily shaped segment-receiving portion 107 of support member 106. Support member 106 also includes a bit attachment portion 110 opposite segment-receiving portion 107. Preferably, segment-receiving portion 107 has a smaller circumference than bit attachment portion 110 and, when viewed from the top thereof, is concentrically positioned upon bit attachment portion 110.

Support member 106 and impregnated segment 102 may be interconnected by known techniques such as by the use of adhesives, brazing, mechanical affixation, or by aggregating the continuous-phase material and abrasive material of impregnated segment 102 directly onto segment-receiving portion 107 of support member 106.

When impregnated segment 102 and support member 106 are interconnected, a peripheral interface 105 is defined between the impregnated segment and support member. Preferably, impregnated segment 102 and bit attachment portion 110 of support member 106 may each have substantially constant cross-sectional (taken transverse to longitudinal axis 112) peripheral circumferences along the heights thereof. The cross-sectional peripheral circumferences of impregnated segment 102 and bit attachment portion 110 are substantially the same. Thus, the edges of impregnated segment 102 and support member 106 at peripheral interface 105 abut each other in a substantially flush arrangement, imparting cutting element 100 with a substantially cylindrical appearance.

Preferably, impregnated segment 102 is fabricated from a continuous-phase material that is impregnated with an abrasive material, such as the continuous-phase materials and abrasive materials described above in reference to the impregnated segment 32 of cutting element 30, shown in FIG. 2. Similarly, the continuous-phase material and abrasive material of impregnated segment 102 may be aggregated by known processes, such as sintering, hot isostatic pressing, laser melting, or ion beam melting. Similarly, support member 106 is fabricated from the same materials and by the same techniques that are described above in reference to support member 36, which is also shown in FIG. 2.

Figure 12:
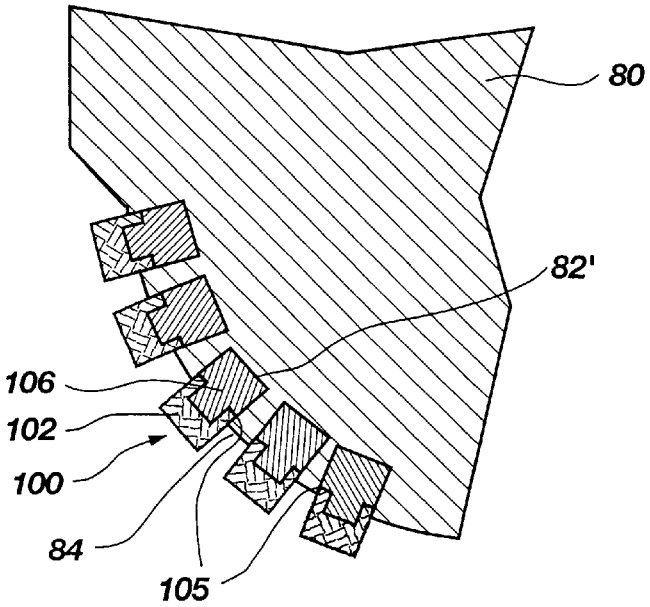
FIG. 12 is a partial vertical cross-sectional view of a bit body, which illustrates the support member of FIGS. 9 and 10 disposed in a socket of the bit body with a portion of the impregnated segment being located within the socket.
Figure 11:
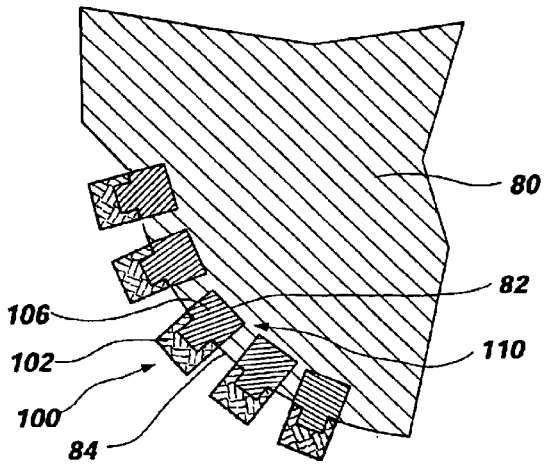
FIG. 11 is a partial vertical cross-sectional view of a bit body, which illustrates the support member of FIGS. 9 and 10 disposed in a socket of the bit body with the entire impregnated segment being located externally relative to the bit face.

Referring now to FIG. 11, bit attachment portion 110 of each support member 106 may be disposed within a socket 82 formed in a face 84 of a bit body 80. Preferably, sockets 82 are shaped complementarily to a corresponding bit attachment portion 110 so as to securely receive cutting element 100. Cutting element 100 may be secured to bit body 80 by techniques such as those described above in reference to FIG. 3. The depth of sockets 82 may be such that, when cutting elements 100 are attached to bit body 80, impregnated segments 102 are located entirely exterior of bit body face 84. Alternatively, as shown in FIG. 12, deeper sockets 82' may receive a lower portion of impregnated segments 102, positioning the lower portion below bit body face 84 and thereby shielding peripheral interface 105 from the drilling surface, debris and drilling fluid that may otherwise penetrate the interface and dislocate impregnated segment 102 from support member 106.

Figure 13:
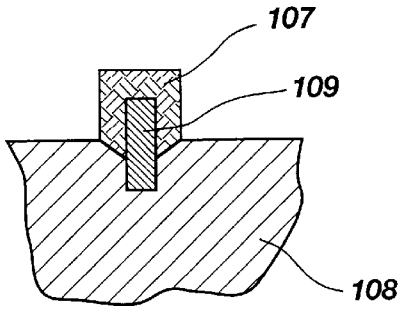
FIGS. 13–15 are cross-sectional views of alternative embodiments of the cutting element, wherein the cutting surface protrudes from the drill bit.
Figure 14:
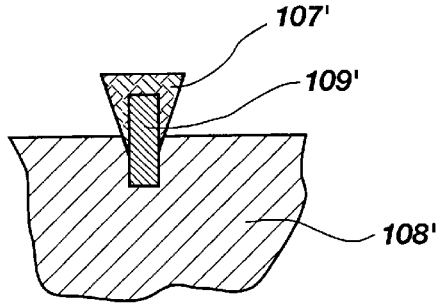
Figure 15:
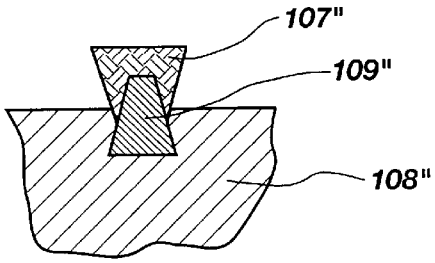

Other variations of cutting element 100 may have noncircular cross-sectional shapes, such as oval, elliptical, triangular, rectangular, other polygonal shapes, or other shapes. Exemplary variations of cutting element 100, which include impregnated segments that protrude from the drill bit, are illustrated in FIGS. 13–15, wherein segments 107, 107', 107" are secured to drill bits 108, 108', 108" by support members 109, 109', 109", respectively.

Figure 16:
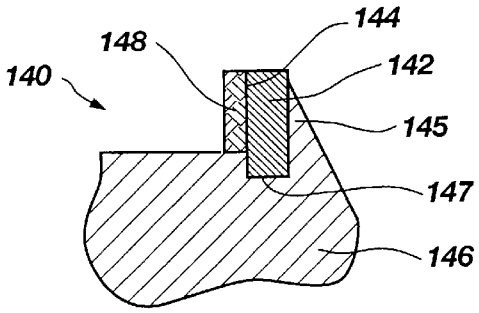
FIG. 16 is a cross-sectional view of another embodiment of the cutting element, wherein the impregnated segment faces the direction of rotation of the drill bit.

With reference to FIG. 16, another embodiment of a cutting element 140 of the present invention is shown. Cutting element 140 includes a support member 142 that is securable to a socket 147 defined in the face of a drill bit 146. Thus, support member 142 extends from drill bit 146. Support member 142 includes a leading face 144 which faces the direction of rotation of drill bit 146. Cutting element 140 also includes an impregnated segment 148 secured thereto and disposed on leading face 144 so as to facilitate contact of impregnated segment 148 with an interior surface of the bore hole during rotation of drill bit 146. Support member 142 may be supported from behind, relative to forces exerted thereagainst during drilling, by a buttress 145 of bit body material.

Figure 16A:
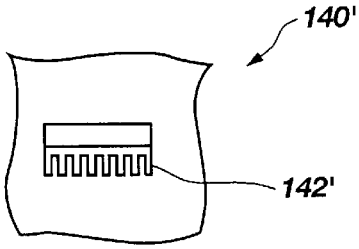
FIG. 16*a* is a top plan view of a variation of the embodiment of FIG. 16.

FIG. 16*a* illustrates a variation of the cutting element 140', wherein the support member 142' includes integral strengthening webs or struts, which configuration facilitates the fabrication of a support member with less material than that of support member 142 of the cutting element 140 of FIG. 16 and also provides additional surface area to bond support member 142 to the bit body.

Figure 17:
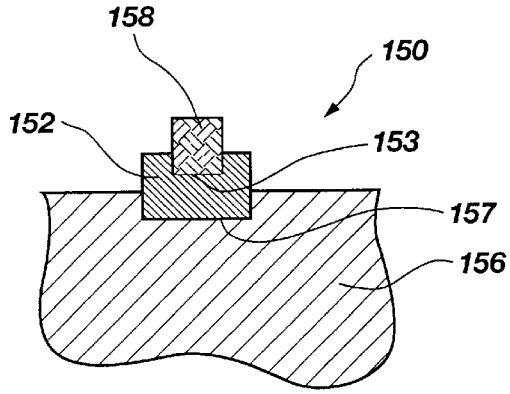
FIG. 17 is a cross-sectional view of another embodiment of the cutting element, wherein the support member includes a recess for receiving the impregnated segment or a portion thereof.

FIG. 17 illustrates yet another embodiment of a cutting element 150, which includes a support member 152 that is securable to a drill bit 156, such as in a socket 157 thereof, and includes a recess 153, which is also referred to as a member-securing portion. Recess 153 is configured to receive an impregnated segment 158, or an extension thereof, and secure the impregnated segment 158 thereto. Support member 152 may alternatively be secured to a matrix-type bit body during infiltration thereof.

Figure 25:
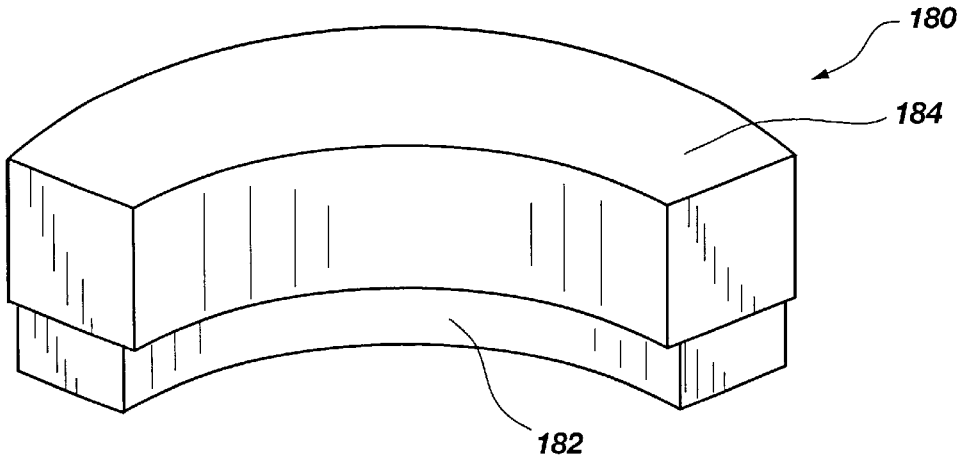
FIG. 25 is a frontal perspective view of an arcuately shaped segment and support member according to the present invention.
Figure 26:
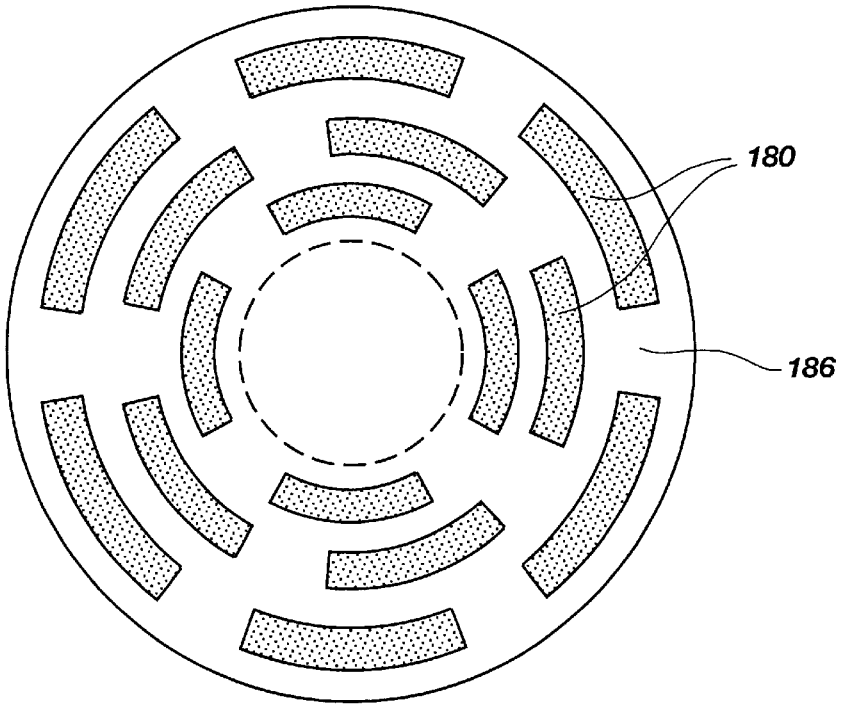
FIG. 26 is an bottom view of a drill bit including the arcuately shaped segments and support members of FIG. 25 disposed thereabout in a circumferential configuration.

FIG. 25 depicts an arcuately shaped cutting element 180 according to the present invention. Cutting element 180 includes a support member 182 that is securable to a drill bit 186 as depicted in FIG. 26, such as by a socket thereof, and includes an impregnated segment 184 disposed thereon.

The support member of the present invention facilitates an increased exposure or profile of the impregnated segments relative to that of conventional impregnated segments. This increased exposure of the impregnated segments prevents the build-up of formation fines on the cutting surface of the impregnated segments, promotes self-sharpening of the impregnated segments, and reduces the surface area of the footprint of the drill bit, which facilitates the use of the drill bit hydraulics to clear formation fines and debris from the surfaces of the borehole and the bit face. Such use of the drill bit hydraulics to remove the formation fines also reduces "pack off," which occurs as fines gather on the impregnated segments, and which may reduce the depth of cut of the drill bit. The increased exposure of the impregnated segments also accommodates the cutting of hard "stringers," such as shale.

Figure 22:
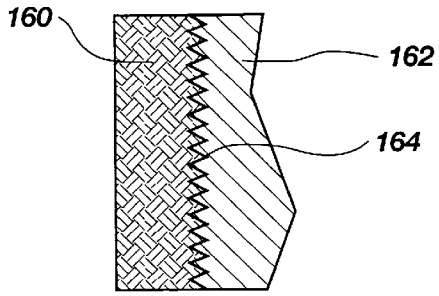
FIGS. 22–24 illustrate exemplary increased surface area interfaces between an impregnated segment and an associated support member.
Figure 23:
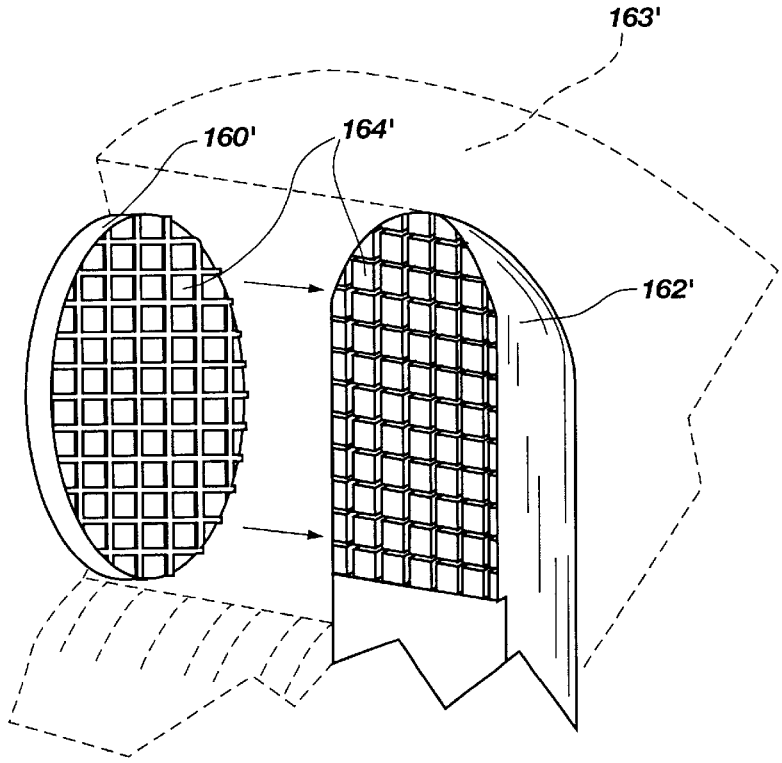
Figure 24:
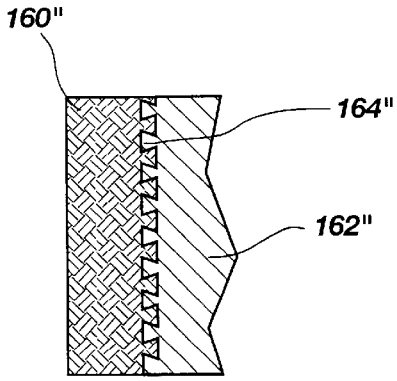

Referring to FIGS. 22–24, to enhance the strength with which an impregnated segment is bound to its corresponding support member, the surface area of the interface 164, 164', 164" between an impregnated segment 160, 160', 160" and its corresponding support member 162, 162', 162", respectively, is preferably increased relative to that as if a flat interface is employed. Accordingly, the segment-retaining portion of the support member 162, 162', 162" and the member-securing portion of the impregnated segment 160, 160', 160", respectively, may each comprise rough, preferably complementary, surfaces. Such high surface area interfaces prevent shearing or delamination of an impregnated segment off of a support member, which may be caused by bending stresses on the cutting element or normal forces on the cutting element parallel to the member/segment interface. Accordingly, the mutually engaging surfaces of the impregnated segment-support member interface 164, 164', and 164" may include complementary thread cut (see FIG. 22), waffle (see FIG. 23), dove-tailed (see FIG. 24), dotted, or cross-hatched surfaces; apertures or blind holes and complementary protrusions; heavily sandblasted or otherwise roughened surfaces; or other configurations that increase the mutually engaging surface areas of the two components. High surface area impregnated segment-support member interfaces are particularly useful in embodiments of the present invention that include relatively large, thin impregnated segments.

With continued reference to FIG. 23, a support member 162' according to the present invention may comprise a blade 163' of the drill bit to which impregnated segment 160' is secured.

Figure 18:
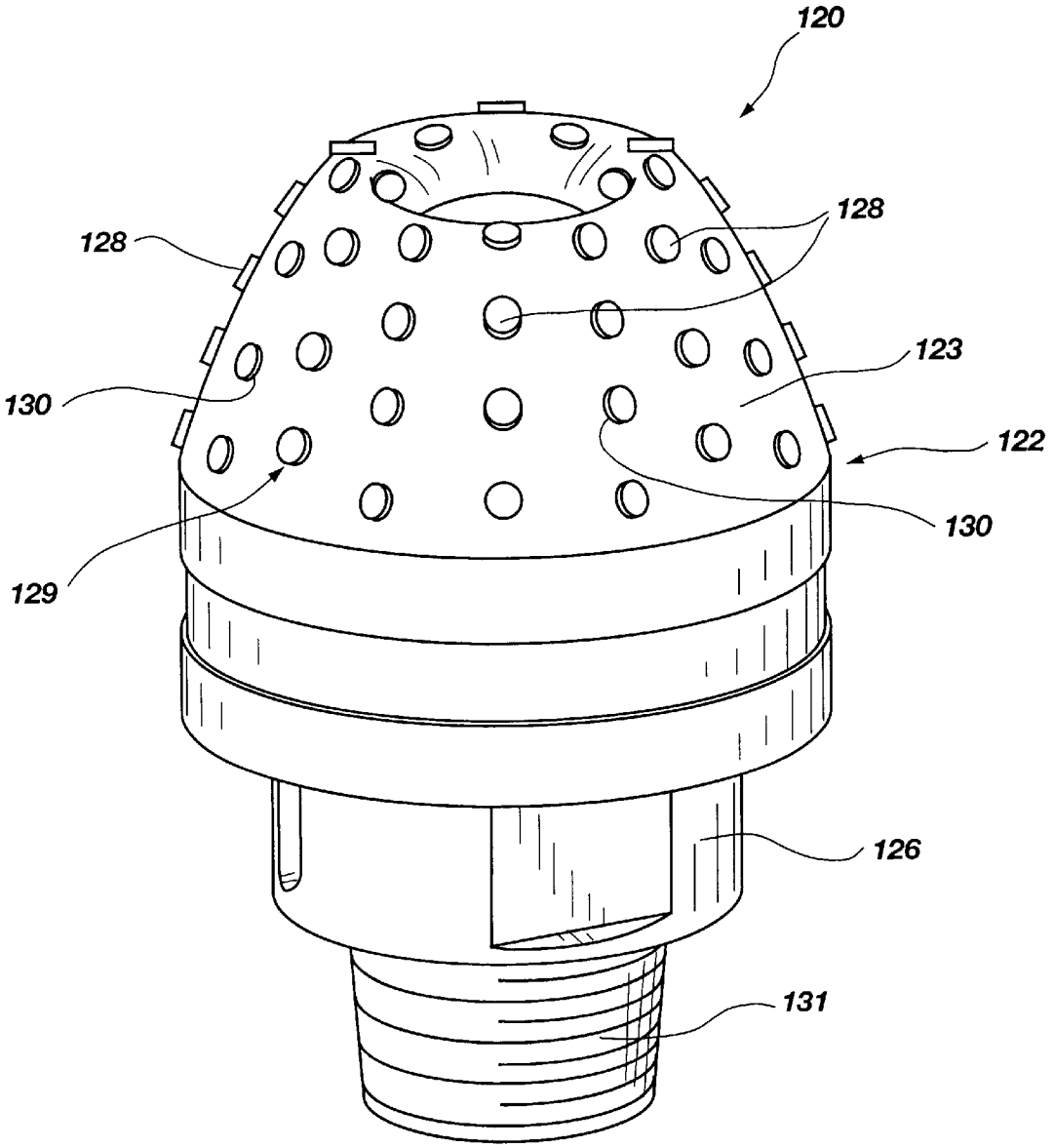
FIG. 18 is an inverted perspective view of a drill bit which carries the cutting elements of FIGS. 4 and 5 or of FIGS. 9 and 10.

FIG. 18 depicts a drill bit 120 which includes a bit body 122, a blank 126 that is partially disposed within the bit body, and a threaded shank 131 extending from the blank, which attaches the drill bit to a drill string, as known in the art. Bit body 122 carries a plurality of cutting elements 128 on the bit face 123 thereof. Cutting elements 128, which are preferably configured similarly to cutting elements 60, 100 described above in reference to FIGS. 5 and 6, and FIGS. 9 and 10, respectively, are preferably disposed in sockets 130 formed in bit face 123. Sockets 130 are preferably shaped complementarily to a bit attachment portion 70, 110 (see FIGS. 5 and 6, 9 and 10, respectively) of cutting elements 128.

Figure 19:
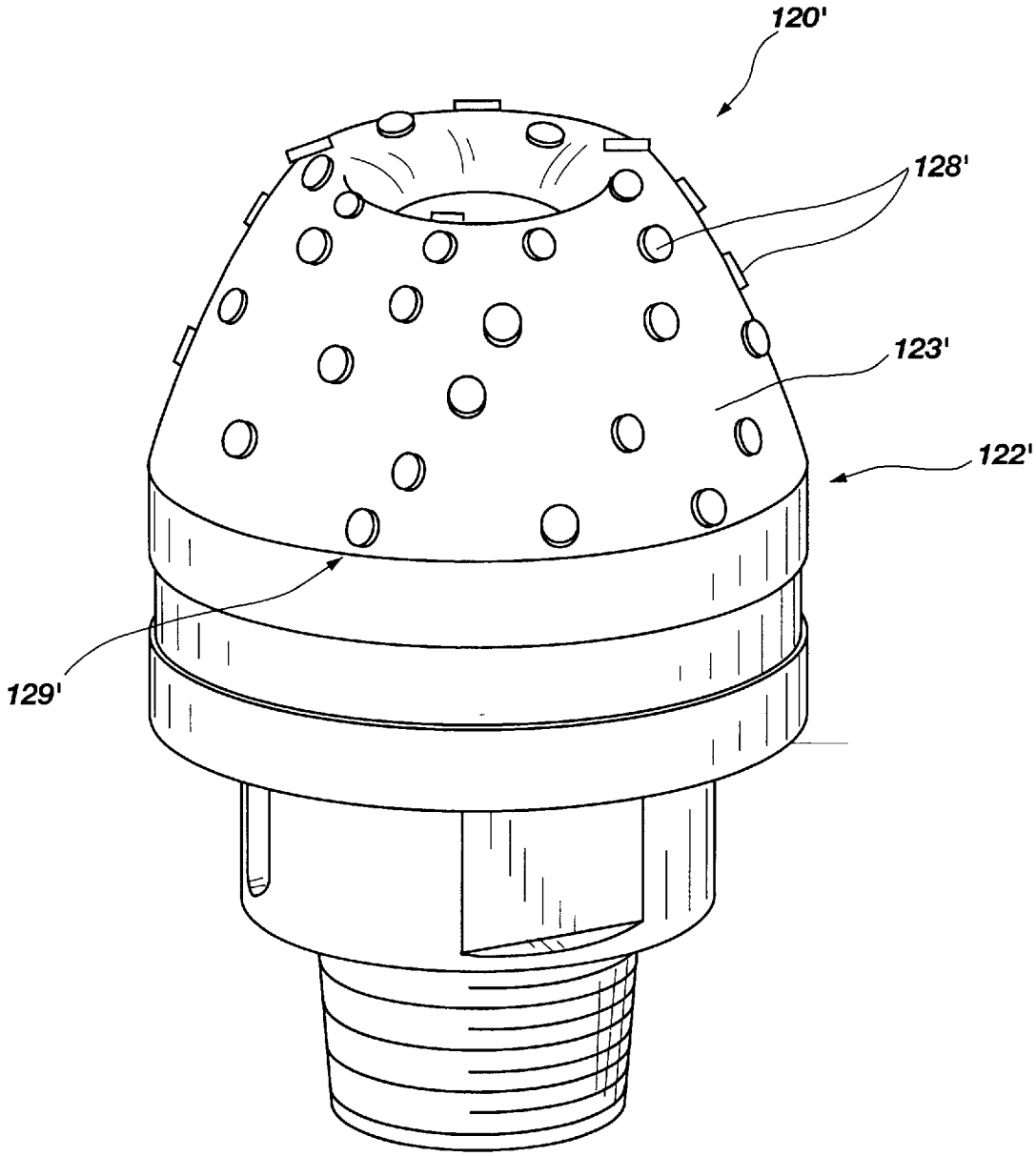
FIGS. 19–21 are inverted perspective views which each illustrate a variation of the drill bit of FIG. 18.
Figure 20:
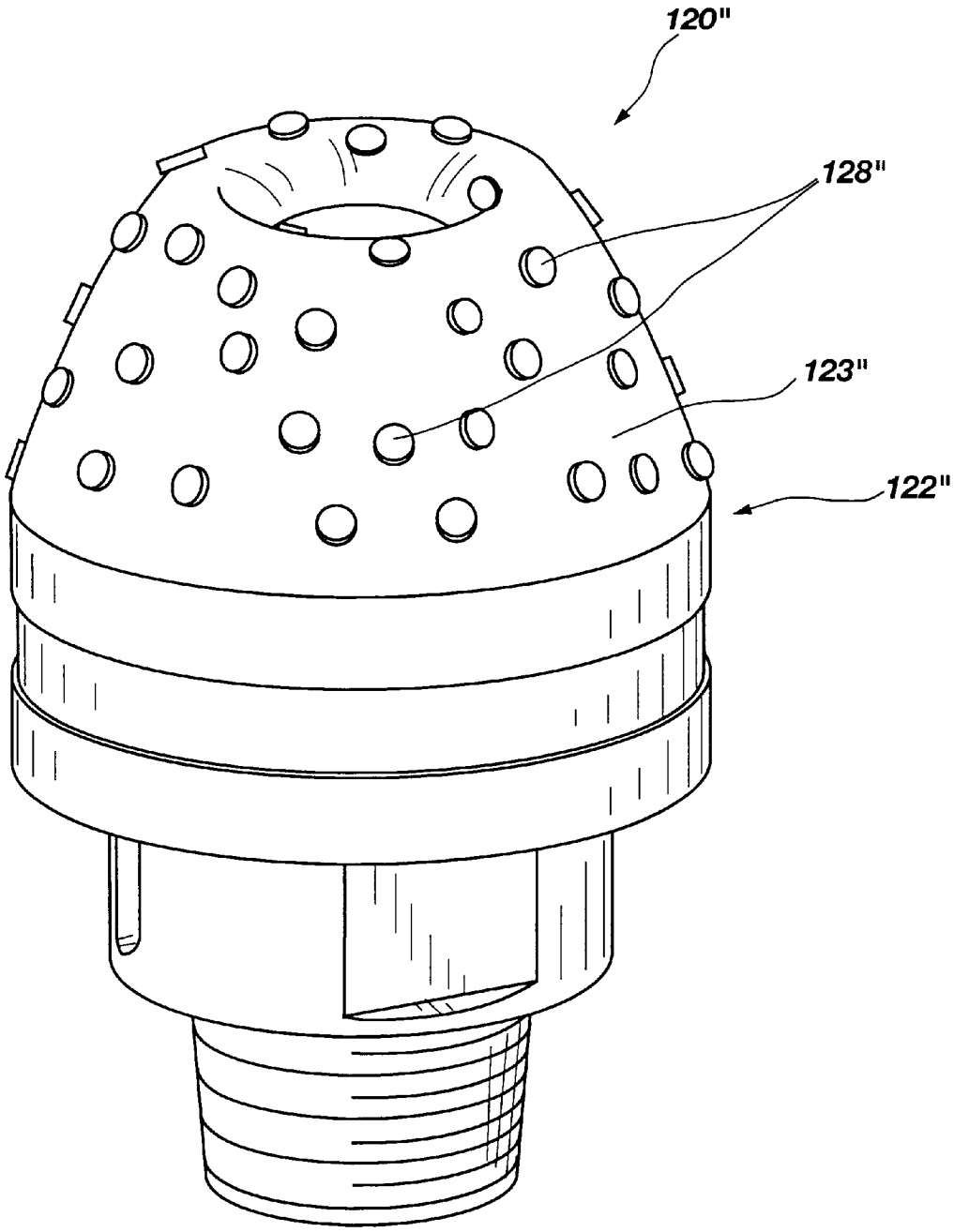
Figure 21:
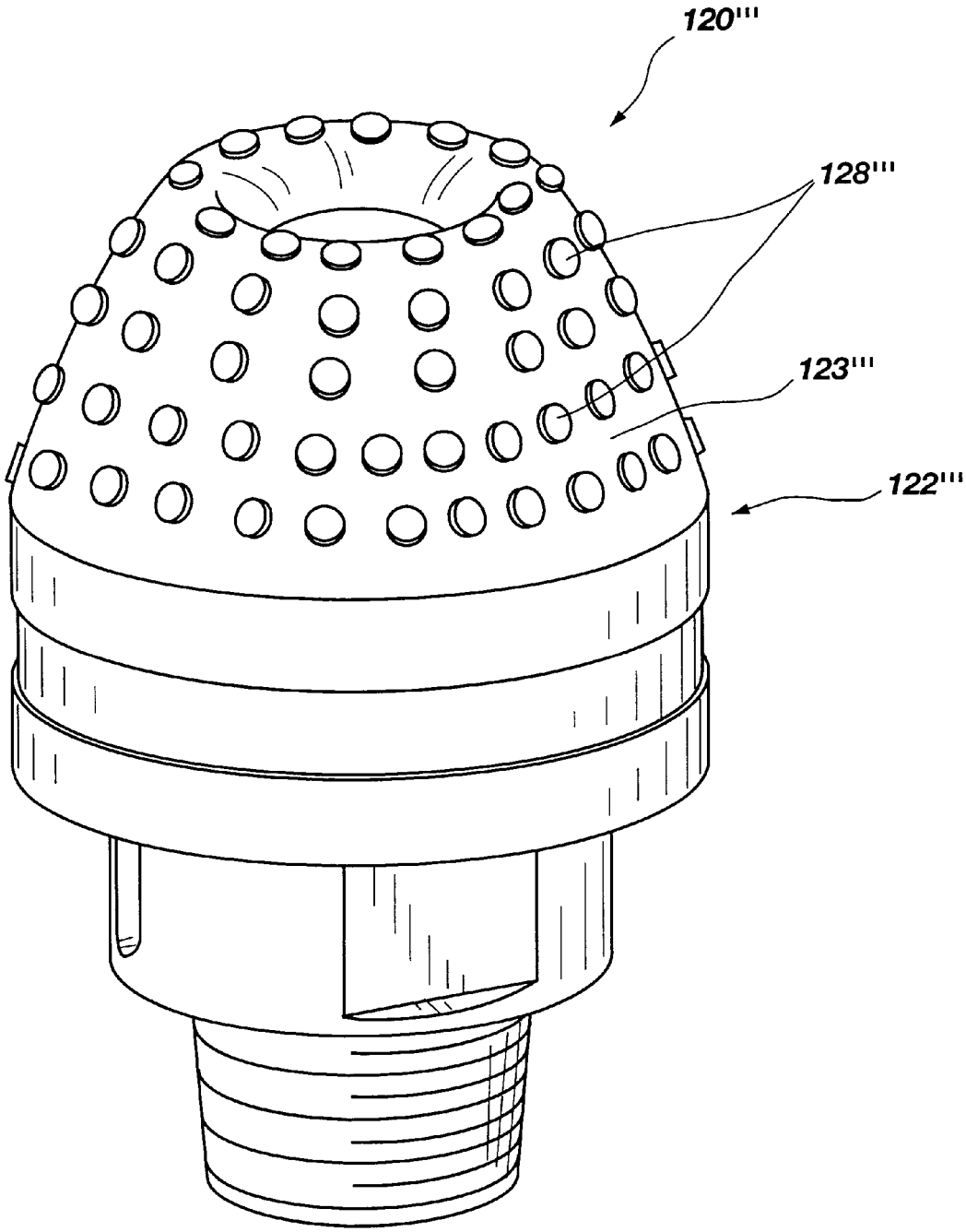

Cutting elements 128 may be arranged in generally radial rows 129 that extend over the crown of bit body 122. Alternatively, as shown in FIG. 19, cutting elements 128' may be disposed upon bit face 123' in rows 129' that extend somewhat spirally over the crown of bit body 122' of drill bit 120'. As another alternative, FIG. 20 illustrates a drill bit 120" that includes cutting elements 128" disposed over bit face 123" of bit body 122" in a nongrouped arrangement. As yet another alternative, FIG. 21 illustrates a drill bit 120'" that includes cutting elements 128'" disposed over bit face 123'" of bit body 122'" in a concentric arrangement. FIG. 26 illustrates a drill bit 186 that includes arcuate cutting elements 180 (see FIG. 25) in a somewhat circumferential arrangement thereon.

Preferably, adjacent cutting elements 128 are arranged on the bit face, such that during drilling, the cutting elements cut the formation surface at the end of the borehole evenly, and at a substantially constant rate.

Referring again to FIG. 18, the support member 66, 106 (see FIGS. 5 and 6, 9 and 10, respectively) of each cutting element 128 is secured within its corresponding socket 130 by known techniques, such as by the use of adhesives, brazing, or mechanical affixation. Alternatively, when support members 66, 106 are porous (e.g., comprised of sintered steel), they may be secured to bit body 122 during infiltration of a matrix material of bit body 122 as described above in reference to FIG. 3.

Due to the use of support members 66, 106 in conjunction with impregnated segments 62, 102, for the same reasons that were discussed above in reference to FIG. 3, cutting elements 128 better withstand the stresses of drilling and, therefore, may be positioned upon drill bit 120 in a manner which improves the hydraulic performance thereof relative to that of conventional impregnated segment-bearing drill bits. Accordingly, an increased amount of drilling fluid may be supplied to bit face 123, which facilitates an increased rate of debris removal from the drilling surface of the bore hole, a reduction in the amount of potentially damaging friction that occurs during cutting, and an increase in the rate at which cutting elements 128 are cooled.

FIGS. 27*a*–45 of the drawings illustrate further features of the present invention.

Figure 27A:
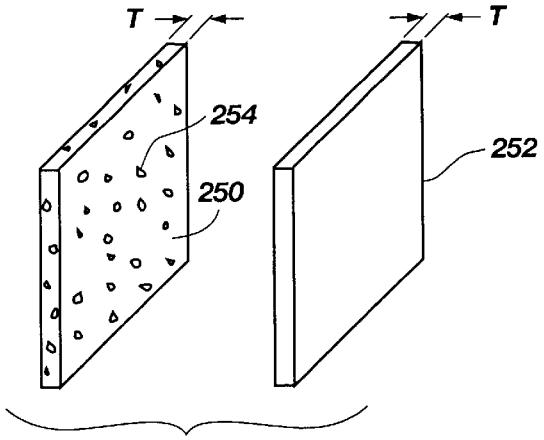
FIGS. 27*a* and 27*b* are perspective views of exemplary solid matrix material segments which can be utilized in embodiments of the present invention. One segment is formed of a solid matrix material and preferably paired with a segment formed of a solid matrix material impregnated with superabrasive particles.
Figure 27B:
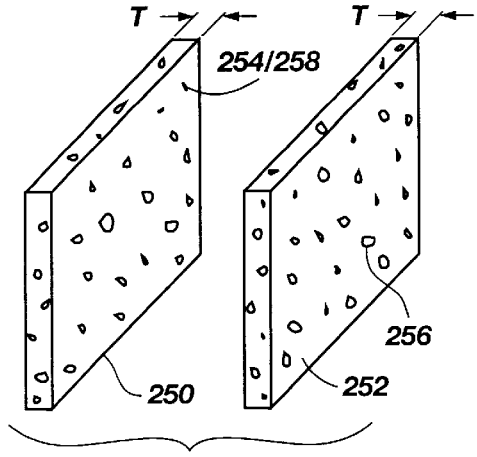

In FIGS. 27*a* and 27*b*, generally rectangularly shaped cutting element segments 250, 252, and 252' are shown, each having a preselected thickness T. Rectangularly shaped segments, or wafers, 250, 252, and 252' are preferably formed of a solid matrix material in a continuous phase as earlier described herein. Such solid matrix material suitable for forming segments 250, 252 and 252' include, but are not limited to, carbides such as tungsten carbide, titanium carbide, silicon carbide, refractory metal alloys, ceramics, copper, copper-based alloys, nickel, nickel-based alloys, cobalt, cobalt-based alloys, silver, or silver-based alloys. Segment 250, for example, is impregnated with a primary material comprising superabrasive particulate material such as natural diamond, or synthetic diamonds such as polycrystalline diamond compact (PDC), thermally stable polycrystalline diamond( ), or polycrystalline cubic boron nitride (PCBN) depicted as superabrasive particles or chips 254. Preferably, synthetic diamond particles, or chips, 254 which range in size between approximately 18 to 48 Tylermesh are dispersed within the material in which segment 250 is formed. Synthetic diamond chips 254 are preferably evenly distributed within the matrix material when constructing the segments by hot isostatic pressing, sintering, laser melting, ion beam melting, or other techniques known within the art to impregnate superabrasive particles within segment 250. Contrastingly, superabrasive-free segment 252 does not have any superabrasive particles or chips and therefore preferably essentially consists of only a solid matrix in a continuous phase. The depicted particles of the superabrasive material impregnated within the various metal matrix segments shown in FIGS. 27*a*–46 are much exaggerated in size in order that the superabrasive particles can be better illustrated within the drawings and distinguished from segments not impregnated with superabrasive particles.

Optionally, segment 252' useable in lieu of superabrasive particle-free segment 252 or in combination with superabrasive particle-free segment 252 may be impregnated with secondary superabrasive particles, or chips, 256, which range in size somewhat smaller than diamond chips 254 provided in segment 250. Another option includes the use of material to provide the superabrasive chips 258 in segment 250 to serve as a primary superabrasive segment and impregnating a lesser amount of natural diamond particles, or chips, 256 to serve as a secondary abrasive segment wherein the relatively more abundant-derived chips within segment 250 causes segment 250 to be more abrasive and wear resistant than segment 252' having a lesser quantity of superabrasive natural diamond particles or chips therein.

Yet another alternative includes the use of abrasive particles, as opposed to superabrasive particles, such as ceramics and aluminum oxides which are particularly suited to serve as lesser, or secondary, abrasive particles 256 to be impregnated into optional segment 252'.

A still yet further option is to impregnate segments 250 and 252' with the same type of superabrasive particles or chips, but to provide a significantly greater quantity of such superabrasive chips within the matrix forming segment 250 than the quantity of such superabrasive chips that are impregnated within the matrix forming segment 252'. That is, providing a significant difference in the quantity, or density, of superabrasive particles within segments 250 and 252', respectively, even if of the same type and particle size of superabrasive material, will provide enough of a relative difference of the total abrasiveness and wear resistance of segments 250 and 252' to provide the benefits of the present invention. As described and illustrated herein, it is intended that it be understood that in all references to and depictions of any particular segment designated or referred to as being essentially free of superabrasive particles or material, a segment comprising, in effect, lesser abrasive superabrasive particles, and/or nonsuperabrasive particles which are not regarded as being superabrasive but which are considered to be abrasive particles, or secondary abrasive particles, could be used in lieu of, or in combination with, the referenced superabrasive-free segment as depicted and discussed herein.

Segments 250, 252, and 252' have nominal thicknesses of less than approximately ½ inch (approximately 12.7 mm) and are preferably approximately ⅛ inch (approximately 3 mm) thick, shown as dimension T, and are approximately one inch (approximately 25 mm) wide and one inch (approximately 25 mm) long. Although the overall dimensions and the thickness of the segments may be considerably greater, by limiting the thickness of the segments to form a "wafer," the consistency and repeatability of forming segments of sufficiently high quality by known pressing and sintering operations will be ensured. This is especially so if using synthetic diamonds, also referred to as thermally stable polycrystalline diamond (TSP), to offset the tendency of relatively thicker TSP-impregnated segments from fracturing during handling and until fully installed and secured within a drill bit. Furthermore, by limiting the thickness in which segments 250, 252, and 252' are formed, enhanced cutting performance will be obtained as a result of hard formation fines, or rock flour, having a reduced tendency of becoming trapped between the edge or edges of the cutting segments which are engaging and thus cutting the well bore. That is, it is preferred that an edge of the segment will serve as the primary formation-engaging surface of the segment as installed in a drill bit. Additionally, by limiting the thickness T of the cutting element segments, a variety of segments can be easily formed wherein the segments can be provided in a wide range of overall configurations and overall sizes. These attributes as well as others will become apparent from the ensuing discussions and illustrations.

Figure 28:
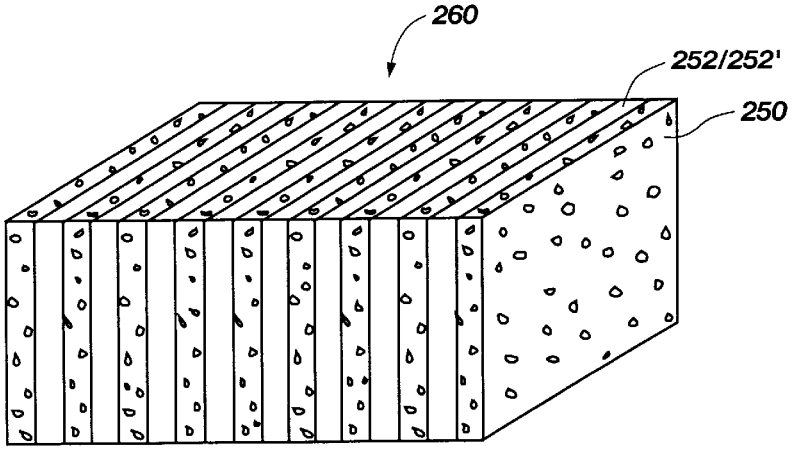
FIG. 28 is a perspective view of an embodiment of the present invention in which a plurality of alternating solid matrix segments and superabrasive impregnated segments form a laminated cutting element.

As shown in FIG. 28, segments 250, 252, or 252' are arranged in alternating fashion to form a laminated cutting element 260. Cutting element 260 can be comprised of any number of segments 250, 252, or 252' in order to form the generally rectangularly shaped laminated cutting element 260. An objective of providing such a laminated cutting element, such as cutting element 260, is to provide an enhanced flow path for drilling fluid, drilling mud, or water to pass between the respective abrasive segments as the laminated cutting element wears while in use. That is, superabrasive impregnated segments 250, being more wear resistant than superabrasive-free segments 252 or abrasive impregnated segments 252', will allow hydraulically induced cleaning or removal of formation fines from between superabrasive impregnated segment 250 and the formation being drilled to form a bore hole. Thus, drilling fluid, drilling mud, or water will have a path in which to flush out fines or rock flour from between the cutting element and the formation being drilled so as to increase the efficiency of the drill bit in which such a cutting element is installed. Furthermore, the drilling fluid, drilling mud, or water, by having improved access to the cutting surface of the cutting element, will better cool the cutting element when high weight-on-bit loads are being used to drill through exceptionally hard formations.

Figure 37:
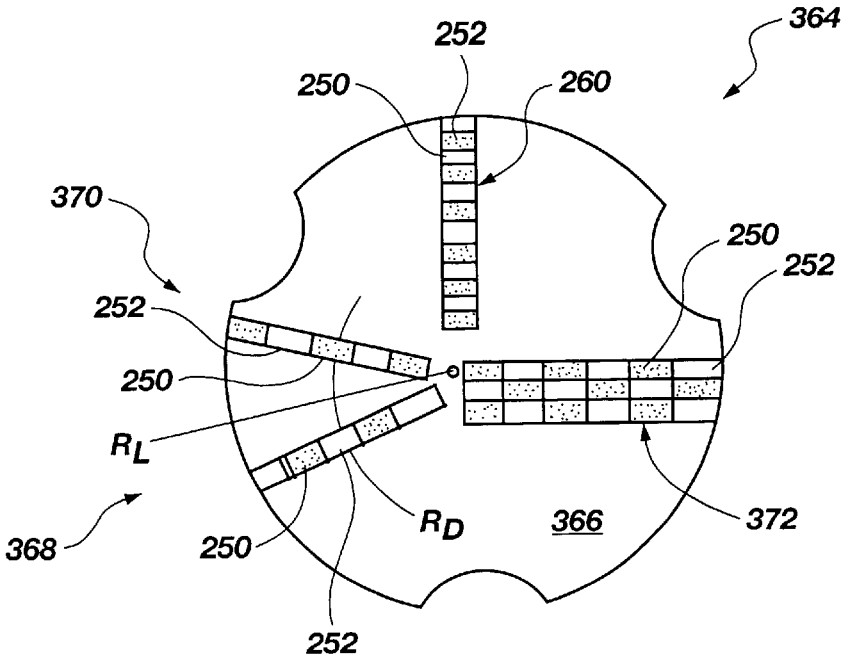
FIGS. 37 and 38 are bottom views of a drill bit illustrating various exemplary radially oriented lamination patterns, or arrays, in which segments can be installed on the face thereof.
Figure 40:
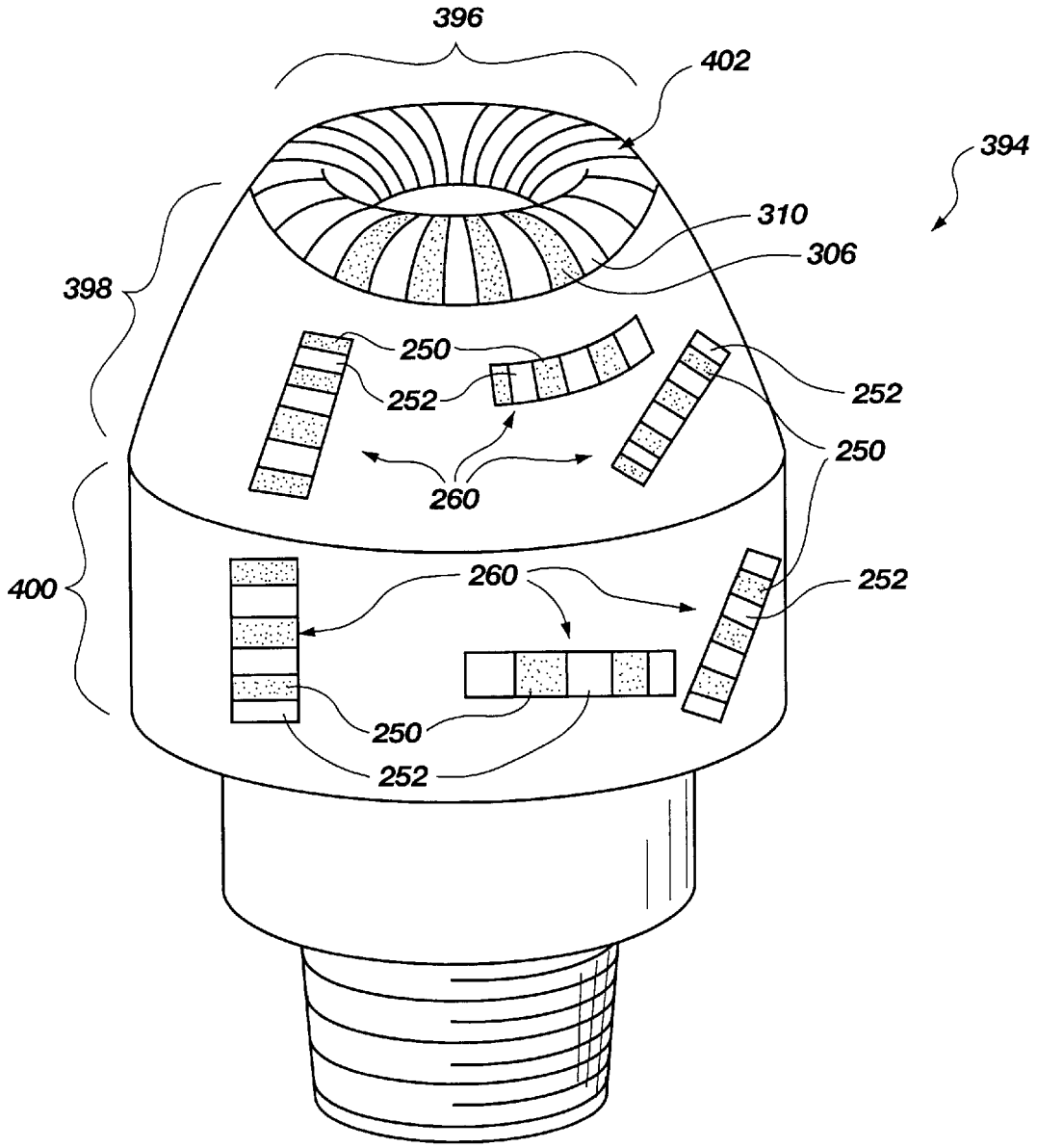
FIG. 40 is a perspective view of a drill bit in which a plurality of segments is illustratively positioned on the nose of the drill bit and arranged in an alternating fashion thereabout; additionally, a radially oriented laminated cutting structure and a circumferentially oriented laminated cutting structure are illustratively depicted as being positioned on the shoulder portion of the drill bit.

Exemplary, generally rectangularly shaped cutting element 260 can be secured directly into a recessed region of a face, or other region, of a drill bit as illustrated in FIGS. 37 and 40, for example. Exemplary rectangularly shaped laminated cutting element 260 can also be installed on a blade structure of a drill bit as provided on blade 412 on drill bit 408 shown in FIGS. 41*a* and 41*b*. The individual segments forming laminated cutting element 260 can be installed on blade 412 by brazing, molding, mechanical affixation, or other attachment processes known within the art. It should be noted that the thickness of the individual segments is exaggerated for clarity within all the drawings.

Although, the generally rectangularly shaped cutting element 260 shown in FIG. 28 is comprised of superabrasive impregnated segment 250 and superabrasive-free segment 252 in an alternating fashion, it should be understood that optional secondary abrasive impregnated segment 252' can be substituted for, or used in combination with, superabrasive-free segments 252. For example, a primary superabrasive impregnated segment 250, a secondary superabrasive-free segment 252, and a secondary abrasive segment 252' comprising either superabrasive particles or abrasive particles within the matrix of segment 252' could be positioned in alternating sequences of three such segments. Furthermore, a wide variety of alternating fashions can be employed including placing the same type of segments side-by-side, end-to-end, etc.

Figure 29:
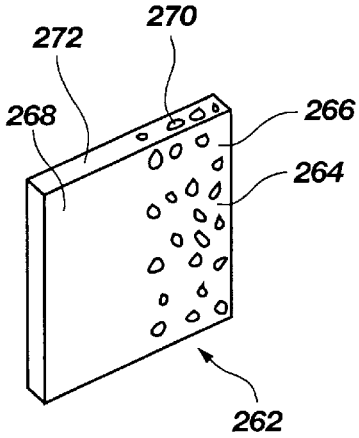
FIG. 29 is an embodiment of the present invention in which a segment formed of a solid matrix material has superabrasive particles impregnated within a portion thereof.

FIG. 29 shows a single cutting element segment 262 formed of a metal matrix as described earlier wherein the segment has superabrasive particles 266, such as discussed previously, impregnated generally within portion 264 and not within portion 268 of segment 262. Such a composite segment is preferably secured to a drill bit so that, upon the drill bit being rotated as known within the art, edge portion 270 will be the leading edge of the segment and edge portion 272 will be the trailing edge portion of the segment as the drill bit rotates about its longitudinal axis and engages the formation during drilling operations. By being mounted in a drill bit in this manner, leading edge 270, having superabrasive particles 266, will be the first edge of segment 262 to engage the formation of the well bore being drilled and trailing edge 272, preferably having no superabrasive particles or relatively less abrasive particles therein, will follow therebehind. Thus, as the composite segment wears, trailing edge 272 will wear slightly quicker than leading edge 270, thereby providing a path in which fluids, such as drilling fluids, drilling mud, or water, can flush formation fines and rock flour away from the leading or cutting edge and thus offer a distinctive advantage over the prior art as discussed previously with respect to the benefits of laminated cutting element 260.

Figure 30:
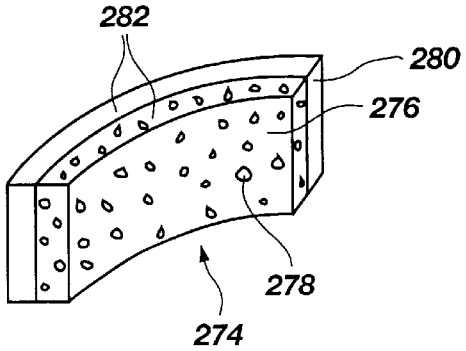
FIG. 30 is a perspective view of an exemplary arcuate laminated cutting element including an arcuate superabrasive impregnated segment and an arcuate solid matrix segment.
Figure 31:
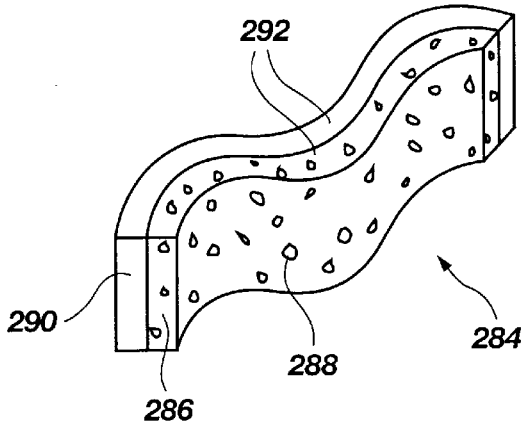
FIG. 31 is a perspective view of an exemplary serpentine laminated cutting element including a serpentine superabrasive impregnated segment and a serpentine solid matrix segment.

Referring now to FIGS. 30 and 31 of the drawings, FIG. 30 shows an arcuately shaped laminated cutting element 274 comprised of a superabrasive impregnated segment 276 having superabrasive particles 278 disposed therein. A superabrasive-free segment 280 is positioned against segment 276 as shown in FIG. 30 to provide the generally arcuately shaped cutting element 274 wherein preferably the upper edges of segments 276 and 280 would provide a cutting surface 282 of cutting element 274. A plurality of segments 278 and 280 can be provided in increasing widths to form a cutting element such as exemplary cutting element 392 provided on face 388 of drill bit 386 illustrated in FIG. 39.

A serpentine, or nonlinear, laminated cutting element 284, as shown in FIG. 31, provides but one example of a variety of irregularly shaped cutting elements that can be formed by providing and laminating a serpentine or irregularly shaped primary superabrasive segment 286 having superabrasive particles 288 therein in combination with a superabrasive-free segment 290 in accordance with the present invention. It is further preferred that upper edges 292 would form the primary cutting surface of cutting element 284.

Figure 32A:
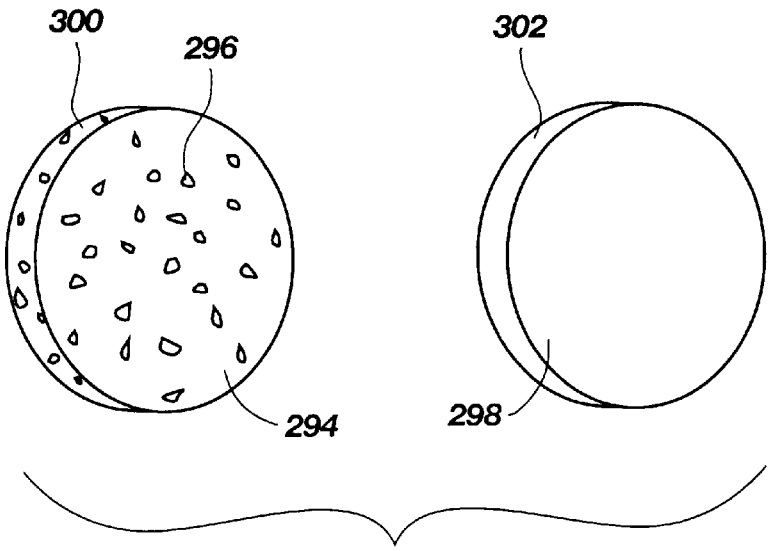
FIGS. 32*a* and 32*b* are respective perspective views of a circular solid matrix segment and a circular solid matrix segment impregnated with superabrasive particles and a laminated cutting element including alternating circular segments.
Figure 32B:
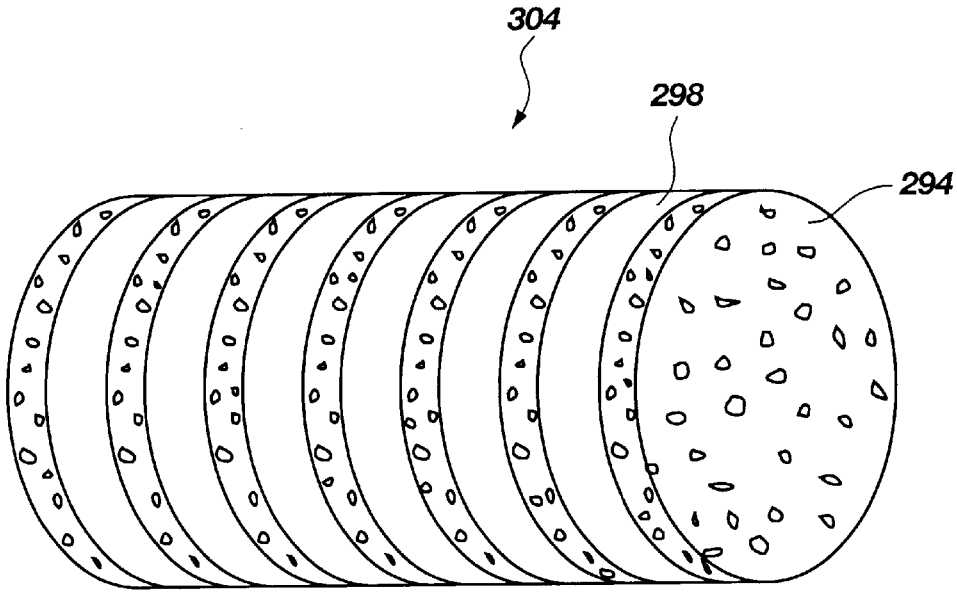

FIGS. 32*a* and 32*b* show another possible configuration in which a laminated cutting element can be provided in accordance with the present invention. A plurality of generally circularly shaped, superabrasive impregnated segments 294 having superabrasive particles 296 therein can be joined with a plurality of superabrasive-free, generally circularly shaped segments 298 to form a cylindrically shaped laminated cutting element 304 as shown. Preferably, respective edges 300 and 302 would provide a primary cutting surface for engaging the formation.

Figure 33A:
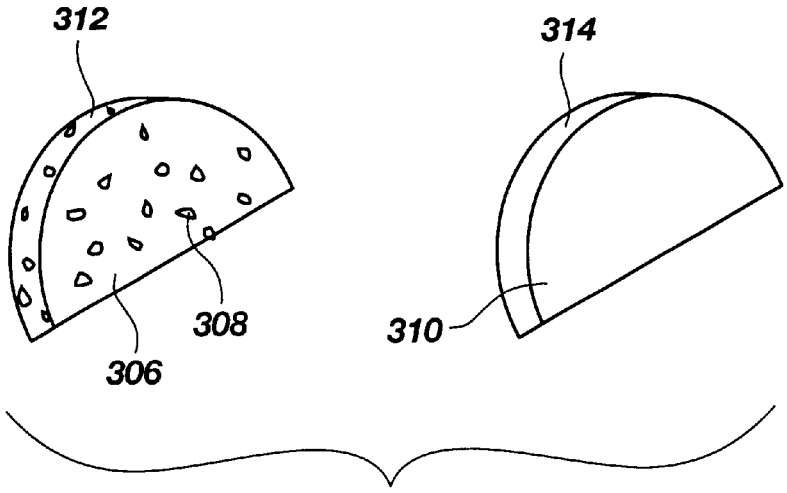
FIGS. 33*a* and 33*b* are respective perspective views of a semicircular solid matrix segment and a semicircular solid matrix segment impregnated with superabrasive particles and a laminated cutting element of alternating semicircular segments.
Figure 33B:
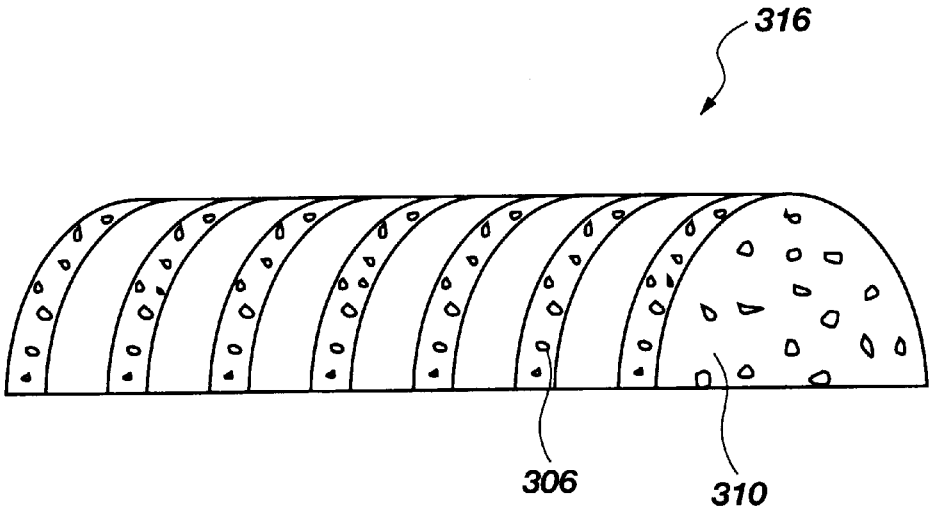

FIGS. 33*a* and 33*b* depict a semicircular configuration comprising a semicircular-shaped cutting element 316 formed of semicircular-shaped superabrasive impregnated segments 306 including arcuate surfaces 312 having superabrasive particles 308 dispersed therein combined with semicircular-shaped superabrasive-free segments 310 including arcuate surfaces 314. Segments 306 and 310 and/or cutting element 316 can be formed initially to have a semicircular configuration or, alternatively, can be formed to initially have a circular configuration and then be machined into halves by methods and equipment known within the art.

Figure 34A:
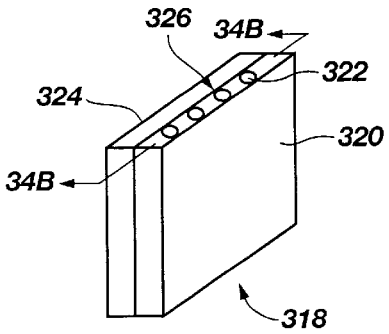
FIG. 34*a* is a perspective view of a laminated cutting element comprising a segment formed of solid matrix material and a segment having a plurality of superabrasive impregnated cylindrically shaped elements therein.
Figure 34B:
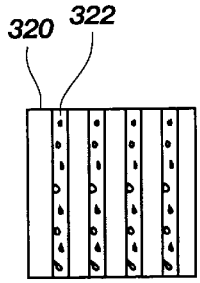
FIG. 34*b* is cross-sectional view of the cutting element as shown in FIG. 34*a;*

An alternative to impregnating superabrasive particles throughout a segment formed of metal matrix is shown in FIGS. 34*a* and 34*b*. As shown in FIGS. 34*a* and 34*b*, laminated cutting element 318 comprises a superabrasive-containing metal matrix segment 320 having a plurality of prefabricated, or discrete cylindrically shaped, particulate superabrasive elements or cylinders embedded therein. Such rod-like, cylindrically shaped particulate superabrasive elements 322 contain natural diamonds, synthetic diamonds, or superabrasive material such as PDC and TSP. Exemplary particulate superabrasive cylinders suitable for being embedded within segment 320 are commercially available. Segment 320 is preferably permanently joined, by sintering/hot isostatic pressing as earlier described, with at least one otherwise superabrasive-free metal matrix segment 324, thus providing an example of using commercially available superabrasive cylinders to provide a cutting element in accordance with the present invention. Preferably, cutting element 318, having alternating pairs of segments 320 and 324, would be installed in a drill bit so as to position upper edges of segments 320 and 324 to provide a cutting surface 326 of cutting element 318 for engaging the formation being drilled. Thus, cylinders 322 are preferably oriented so as to provide a continuous supply of particulate superabrasive material at cutting surface 326 as cutting element 318, preferably comprised of a plurality of superabrasive segments 320 and superabrasive-free segments 324, wears when in use.

Figure 35A:
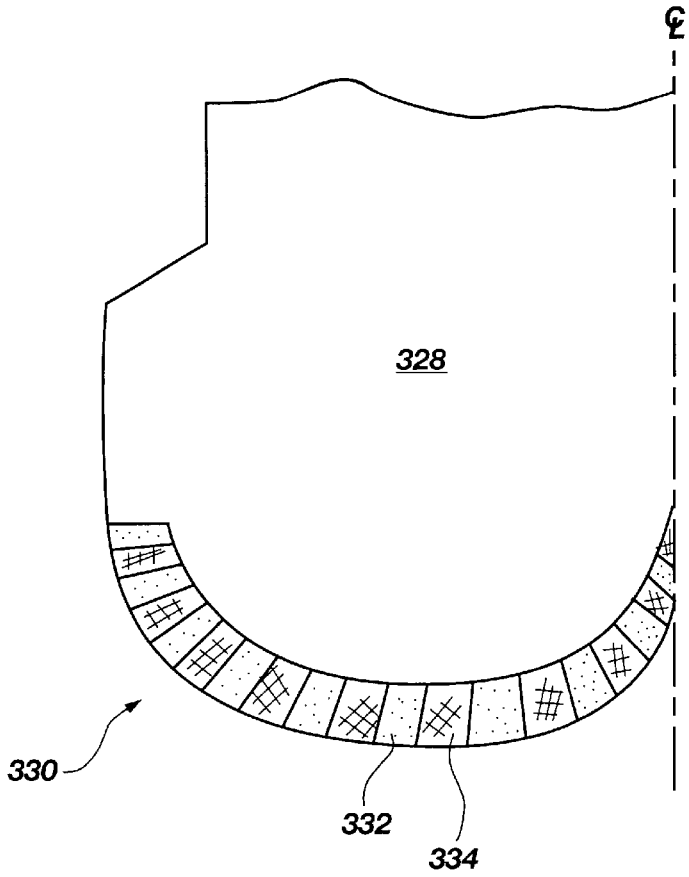
FIG. 35*a* is a broken-away cross-sectional view of a drill bit in which a plurality of alternating segments has been positioned about the crown to form an exemplary cutting element.
Figure 35B:
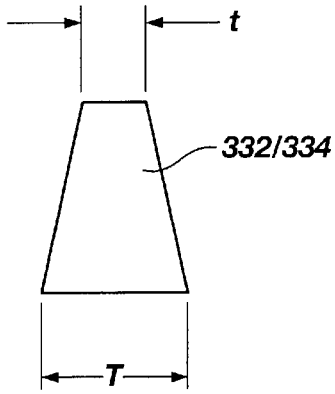
FIG. 35*b* is an exaggerated frontal view illustrating the nonconstant thickness of segments shown in 35*a;*

Turning now to FIGS. 35*a* and 35*b* of the drawings, an exemplary drill bit 328 having a laminated cutting element 330 in accordance with the present invention is shown in FIG. 35*a*. Cutting element 330 is disposed on drill bit 328 so as to extend from the longitudinal centerline of the drill bit outward about the nose and the crown of drill bit 328. Cutting element 330 is comprised of a preselected alternating pattern of superabrasive cutting segments 332 and superabrasive-free segments 334. In order for cutting element 330 to have such a varied geometry, segments 332 and 334 can be formed in the shape of a wedge, as illustrated in FIG. 35*b*, so as to be able to follow the contour of the nose and crown of drill bit 328. In other words, segments formed in accordance with the present invention need not have a uniform thickness but can have a nonconstant thickness, ranging from a thickness T at one end of a segment to a lesser thickness t at the opposite end of a segment as illustrated in FIG. 35*b*, in order to provide segments that can be arranged to form cutting element configurations for essentially any drill bit whether mounted directly on the bit face or upon a standoff cutting structure such as a blade. The term "nominal thickness" as used herein with respect to segment thickness is to denote that the segment may have a less than perfectly uniform thickness throughout its cross-section and, in some embodiments of the present invention, may be preferred. That is, a particular segment can have an actual minimum thickness or cross-section in one portion and an actual maximum thickness or cross-section in another portion wherein both thicknesses would fall within an acceptable range of variance of the remainder of the segment. The term "substantially nonuniform thickness" as used herein with respect to segment thickness denotes that a segment has a thickness that varies widely in cross section. Furthermore, a single segment or a plurality of segments, each having either a nominal thickness or alternatively a substantially nonuniform thickness, can be utilized to form a laminated cutting structure in which the segments would respectively accommodate the converse in thickness of the adjacently positioned segments. For example, a portion of a first superabrasive impregnated segment having a reduced thickness, or cross-section, within that particular portion can be so arranged and assembled to be complementarily positioned to accommodate a portion of a second adjacently positioned superabrasive-free or lesser abrasive segment having a corresponding relatively increased thickness, or cross section.

Figure 36:
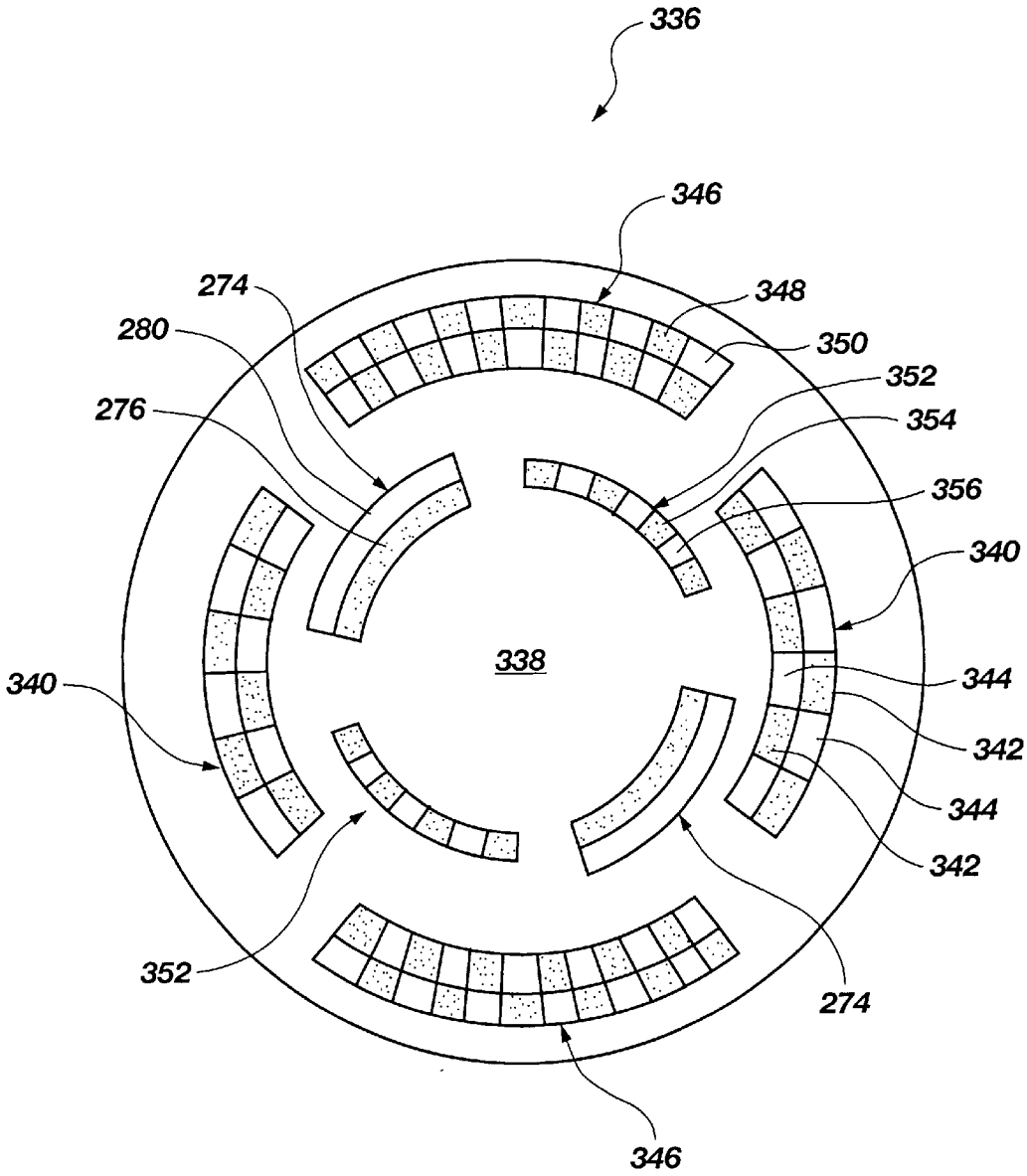
FIG. 36 is a bottom view of a drill bit illustrating various exemplary circumferentially oriented lamination patterns, or arrays, in which segments can be installed on the face thereof.

FIG. 36 of the drawings depicts a drill bit 336 having a variety of representative laminated cutting elements installed onto face 338 which generally have a circumferential or arcuate configuration. However, it should be understood that actual drill bits incorporating the features of the present invention may have the entire face of the drill bit essentially covered by laminated cutting elements, whether of a circumferential configuration or other configuration, or the face may have only a few selectively positioned cutting elements, or the cutting elements may be symmetrically positioned or asymmetrically positioned and so forth.

For example, oppositely positioned laminated cutting elements 340 comprised of two rows of alternating superabrasive impregnated segments 342 and superabrasive-free segments 344 wherein the individual segments may be oriented circumferentially to form a preselected array or pattern of segments to define cutting element 340 can be provided. That is, the thinnest portion of the individual segments is generally oriented circumferentially with respect to the drill bit. Contrastingly, oppositely positioned laminated cutting elements 346 comprised of two rows of alternating superabrasive impregnated segments 348 and superabrasive-free, and/or lesser abrasive, segments 350 is shown having the individual segments generally aligned radially. That is, the thinnest portion of the segments is generally aligned radially with respect to the drill bit.

Oppositely positioned laminated cutting elements 352 having alternating superabrasive impregnated segments 354 and superabrasive-free, or lesser abrasive, segments 356 serve to illustrate a single-row style of laminated cutting element wherein the segments are aligned radially. Optionally, the segments could, of course, be oriented circumferentially or at a selected angle with respect to an imaginary reference line extending radially from the center of the drill bit outward to the gage of the drill bit if desired.

Laminated cutting elements 274, as previously discussed and shown in FIG. 30, comprising superabrasive impregnated segments 276 and superabrasive-free segments, and/or less abrasive segments, 280 are positioned opposite each other to serve as an example of a two-segment, circumferentially oriented, laminated cutting element as installed upon the face of a drill bit.

Figure 38:
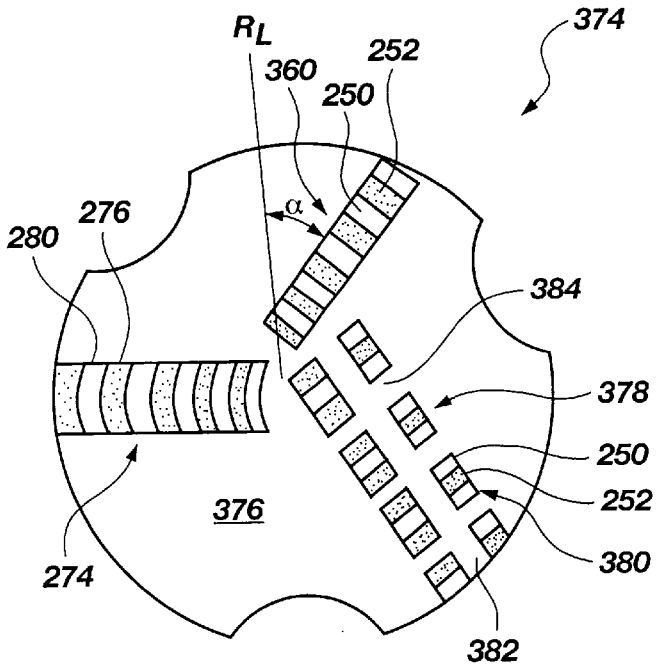
Figure 39:
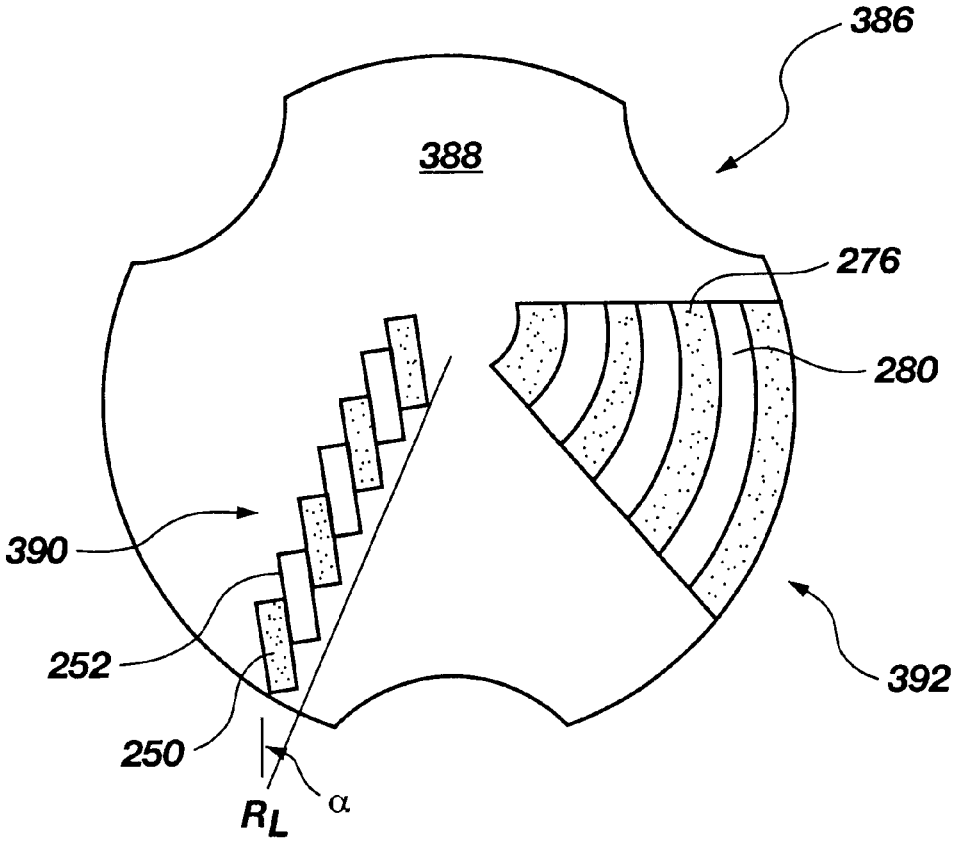
FIG. 39 is a bottom view of a drill bit illustrating an exemplary radially oriented blade structure in which alternating segments are arranged thereon in an angled manner.

Referring now to FIGS. 37, 38, and 39, drill bits 364, 374, and 386 generally have bit bodies that are not designed for coring operations. That is, the faces of the respective bit bodies of the drill bits are generally continuous and non-hollow with the exception of various fluid passages for allow drilling fluid to be pumped down the interior of the tool string, through the interior of the drill bit and which is directed generally outwardly from the face of the bit to facilitate hydraulic flushing of the bit and the formation being drilled. The various representative cutting elements shown on the drill bits illustrated in FIGS. 37–39 provide examples of laminated cutting elements being oriented so as to extend generally radially on the face of the bit body.

Laminated cutting element 260 located on face 366 is comprised of superabrasive impregnated segments 250 and superabrasive-free segments 252. Cutting element 260 provides an example of a simple single row of laminated segments in which the individual segments are generally oriented circumferentially, or tangentially, with respect to the drill bit.

Laminated cutting element 368 has superabrasive impregnated segments 250 and superabrasive-free segments 252 positioned in an alternating end-to-end arrangement in a generally radially oriented fashion. Laminated cutting element 370 located adjacent to cutting element 368 also has superabrasive impregnated segments 250 and superabrasive-free segments 252 positioned in an alternating end-to-end arrangement in a generally radially oriented fashion. However, the respective segments in cutting elements 368 and 370 are radially staggered, or offset, so that, upon a given radial distance from the longitudinal center of the drill bit ($R_D$), a superabrasive impregnated segment will be flanked by a proximate superabrasive-free or lesser-abrasive segment at its side to provide a more consistent and uniform sweep of the superabrasive impregnated segments as the bit is rotated and engages the formation. In other words, by ensuring that superabrasive impregnated segments sweep across most if not all of the face of a drill bit with respect to an imaginary reference line extending outwardly from the longitudinal centerline of the drill bit, any tendency of undesired kerfing will be eliminated, providing a more uniform and consistent cutting or abrading action between the drill bit and the particular layer of the formation in which a well bore is being formed by drilling. Preferably, the laminated cutting elements will protrude slightly above face 366 so as to enhance the hydraulic flushing and cooling of the segments as they engage the formation during drilling.

Laminated cutting element 372 provides an example of a laminated cutting element comprising three radially oriented rows of alternating superabrasive impregnated segments 250 and superabrasive-free segments 252 arranged in a preferred pattern with each segment being of opposite kind to the segment radially positioned to its side, if any. In other words, for a given superabrasive impregnated segment 250 in any given row, a superabrasive-free segment 252 is positioned at the same general distance along $R_L$ within the adjacent radially oriented row of segments to provide a circumferentially alternating arrangement of segments. By circumferentially alternating superabrasive impregnated segments with superabrasive-free or lesser-abrasive segments, drilling fluids will have better access to the superabrasive impregnated segment via the circumferentially positioned, quicker wearing superabrasive-free segment(s) as the drill bit rotates and thereby provide better flushing and cooling of the superabrasive impregnated segments. As will be apparent to those skilled in the art, cutting elements having more than three radially oriented rows of segments can be provided with or without spaces therebetween. Furthermore, if spaces, or watercourses, are provided between radially oriented rows of segments, such spaces need not be limited to being generally radially oriented spaces, or watercourses, but could be circumferentially, or tangentially, oriented as shown in FIG. 38. Further, more spaces, or watercourses, could be oriented at an angle and/or configured to have a spiral shape (not shown).

Drill bit 374 depicted in FIG. 38 is provided with a representative laminated cutting element 360 comprising generally radially oriented alternating superabrasive impregnated segments 250 and superabrasive-free segments 252 which have been positioned on face 376 at an angle $\alpha$ with respect to a reference line designated as $R_L$ to provide an angled laminated cutting element which, as a result, is also positioned at an angle $\alpha$ with respect to the imaginary reference line $R_L$. Angle $\alpha$ can range from 0° to 180°. Of course, multiple rows of segments could likewise be provided, with or without watercourses, etc.

Laminated cutting element 274, comprised of arcuately shaped segments 280 and 276 discussed and illustrated previously, provides an example of a generally radially oriented cutting element in which arcuately shaped segments are positioned in a single row. Segments having other shapes could be used as well to form a generally radially oriented cutting element, including serpentine, or irregularly shaped, segments 286 and 290 illustrated in FIG. 31, for example. Furthermore, multiple rows of like-shaped or differently shaped segments could be utilized to form such cutting elements.

Cutting element 378 provides an example of a cutting element having generally parallel, radially oriented rows of sub-cutting elements 380 comprised of generally tangentially, or circumferentially, oriented superabrasive impregnated segments 250 and superabrasive-free segments 252. In this embodiment, a radially oriented watercourse 382 is provided in combination with a plurality of tangentially oriented watercourses 384 to separate or space apart the sub-cutting elements 380 of cutting element 378.

FIG. 39 depicts a drill bit 386 having a generally triangular, or wedge-shaped, laminated cutting element 392 comprised of alternating arcuately shaped superabrasive impregnated segments 276 and superabrasive-free segments 280. As can be seen in FIG. 39, the overall widths of segments 276 and 280 progressively increase with respect to the radial distance in which each respective segment is positioned from the center of face 388. In practice, preferably a plurality of such wedge-shaped laminated cutting elements 392 would be provided on the face of a drill bit. Furthermore, such one or more wedge-shaped laminated cutting elements can be provided on the face of a drill bit in combination with differently shaped laminated cutting elements in accordance with the present invention, or can be combined with conventional priorly known cutting elements if so desired.

Laminated cutting element 390 provides an example of a generally radially oriented laminated cutting element in which superabrasive impregnated segments 250 and superabrasive-free segments 252, or alternatively shaped segments, are positioned in a staggered relationship and are collectively angled at a preselected angle a with respect to an imaginary reference line $R_L$ extending radially outward from the center of drill bit 386. Angle $\alpha$ can range from 0° to 180°. By staggering and angling segments 250 and 252, the resulting cutting element, upon the drill bit being rotated during the drilling process, will expose the cutting elements at an angle with respect to the cutting path of the respective segments, thereby enhancing the hydraulic flushing action of formation fines and/or rock flour from between the exposed cutting surfaces of superabrasive impregnated segments 250 and the formation being drilled. The superabrasive-free segments 252, which also contribute to the cutting of the formation, will tend to wear more quickly than segments 250 and will thus provide adjacent channels in which drilling fluid or water can better access superabrasive impregnated cutting segments 250. As with wedge-shaped cutting element 392, in practice, a plurality of cutting elements 390 having a plurality of angled and staggered segments would preferably be provided on a drill bit.

Referring now to FIG. 40, depicted is a drill bit 394 having nose region 396, a shoulder region 398, and a gage region 400. Bit 394 may be a coring bit wherein the centermost portion of the bit is hollow or bit 394 may be generally shaped the same as a conventional diamond bit having rings in the center portion of drill bit 394 as shown and discussed in the previously incorporated Rowley '048 patent. Representative coring drill bit 394 is particularly suitable for the installation of semicircular superabrasive impregnated segments 306 and superabrasive-free segments 310 to be installed about nose region or crown portion 396 to form a generally annular-shaped laminated cutting element 402 embodying the present invention. Cutting element 402 provides the primary cutting portion of drill bit 394; however, other laminated cutting elements can be provided on other portions of the drill bit as needed or desired. By way of example, cutting elements 260 comprised of superabrasive impregnated segments 250 and superabrasive-free segments 252 can be installed generally radially, tangentially, or at an angle on shoulder region 398 and gage region 400 as deemed appropriate for the design parameters and earth formations in which a given drill bit is designed to be used.

Figure 41A:
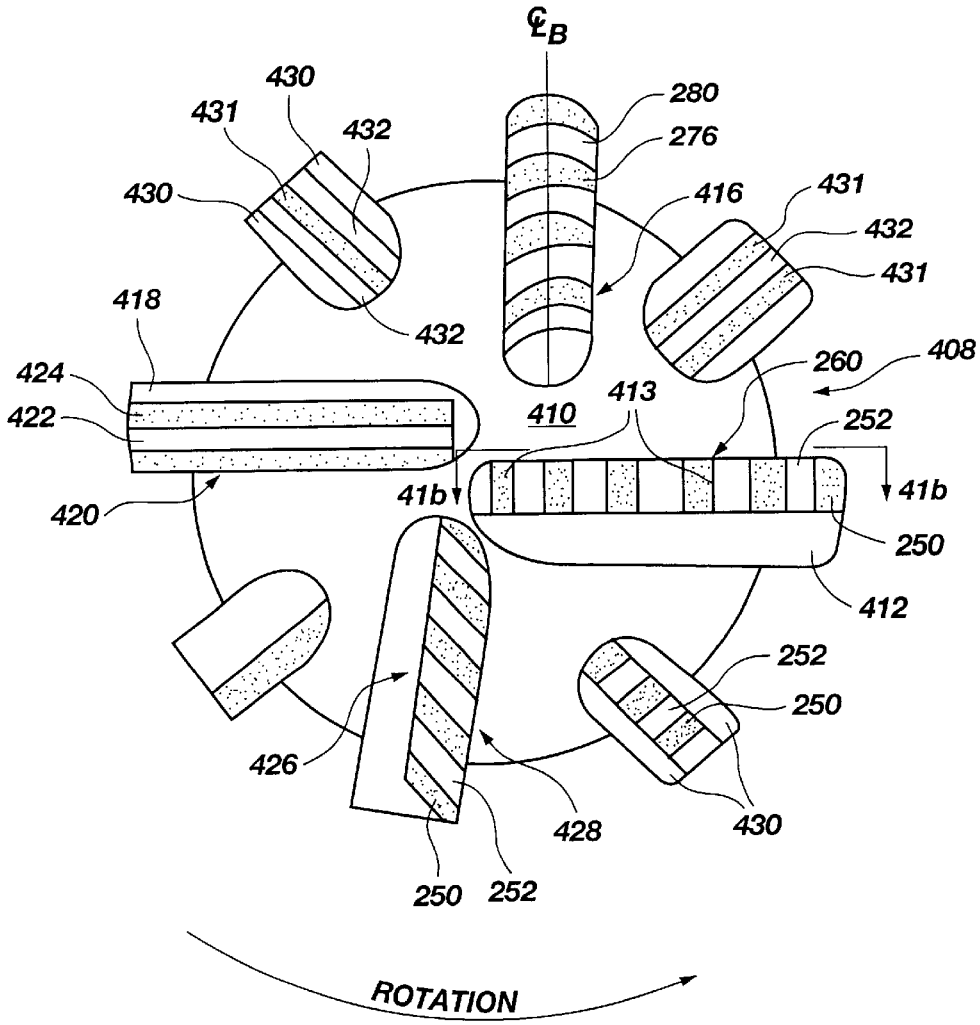
FIG. 41*a* is a bottom view of a drill bit having blade structures in which alternating laminated segments have been positioned thereon to form exemplary patterns, or arrays.
Figure 41B:
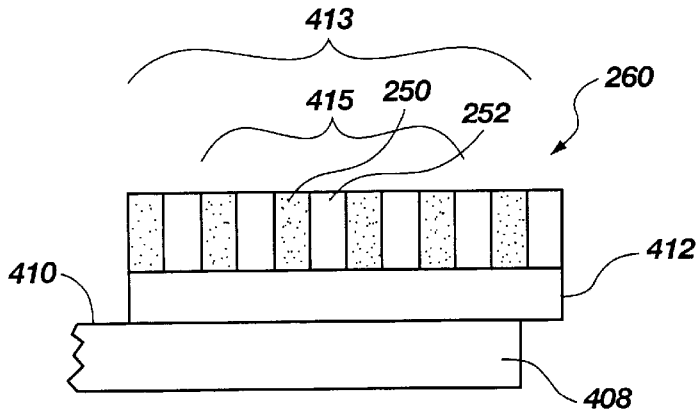
FIG. 41*b* is an isolated front elevation view of the leading surface of blade 412 along the line 41*b*—41*b* of FIG. 41*a;*

Reference is now made to FIG. 41*a* of the drawings, wherein a bladed-style drill bit 408 having a plurality of blade structures disposed onto face 410 and which generally wraps around the crown of the drill bit toward the gage region is depicted. The conventional right-hand rotation of bit 408 is shown with the view of bit 408 being of one looking downward while face 410 of bit 408 is facing upward. Blade 412 extending radially across face 410 is provided with an exemplary laminated cutting element 260 having alternating superabrasive impregnated segments 250 and superabrasive-free segments 252 juxtapositioned transversely along the leading edge of blade 412. Numeral 413 denotes the footprint of the generally upwardly facing surfaces of segments 250 and 252, as installed on blade 412 if one were to look downward thereon. FIG. 41*b* provides a front elevation view of generally leading edge of blade 412 comprising edges of segments 250 and 252 as well as a portion of blade 412, which together comprise the leading edge of blade 412. Thus in this particular embodiment, the cutting surface of laminated cutting element 260 would be both the upwardly facing edges of segments 250 and 252 as well as the edges of segments 250 and 252 which are generally perpendicular to face 410. This particular embodiment of the present invention, including the other exemplary laminated cutting elements shown in FIG. 41*a*, provides a drill bit which is particularly suitable for drilling in both soft and hard formations. When drilling in soft formations with a bladed bit embodying the present invention, generally the entire leading edge of blade 412 as well as the upwardly facing surface of blade 412 as shown in FIGS. 41*a* and 41*b* both engage the formation being drilled. Upon drill bit 408 contacting harder formations, the upwardly facing surface 413 becomes the primary cutting surface as the hard formation prevents the leading surface 415 from fully engaging the formation as is possible when drilling through soft formations in which the blade can "bite" more thoroughly thereinto. Furthermore, the small "footprint" of the primary cutting surface of the segments when drilling in hard formations offers distinct advantages with respect to drilling fluids having greater access to the cutting surface to flush formation fines away therefrom and to cool the primary cutting surface of the segments, which is critical when drilling in hard formations. Thus, a bladed drill bit such as representative drill bit 408 provided with laminated cutting elements in accordance with the present invention can provide significant cost savings in the drilling of wells that pass through soft and hard formations by not requiring pulling the drill bit, replacing it for another, and rerunning the drill bit specifically designed for the particular formation being drilled.

Furthermore, the improved drilling fluid hydraulics attributable to the relatively small footprint of the primary cutting surfaces of the segments promotes longer bit life and better bit performance, especially when drilling in hard formations.

Blade 416 is provided with an alternative laminated cutting element comprising alternating arcuately shaped superabrasive impregnated segments 276 and superabrasive-free segments 280.

Blade 418 is provided with a laminated cutting element 420 comprised of generally radially oriented, elongated superabrasive impregnated segments 424 arranged in an alternating fashion with superabrasive-free elongated segments 422 and wherein cutting element 420 is preferably positioned along the leading edge of blade 418.

Blade 426 is provided with a generally radially oriented laminated cutting element 428 comprised of angled segments 250 and 252 wherein cutting element 428 is preferably positioned along the leading edge of blade 426.

Figure 43A:
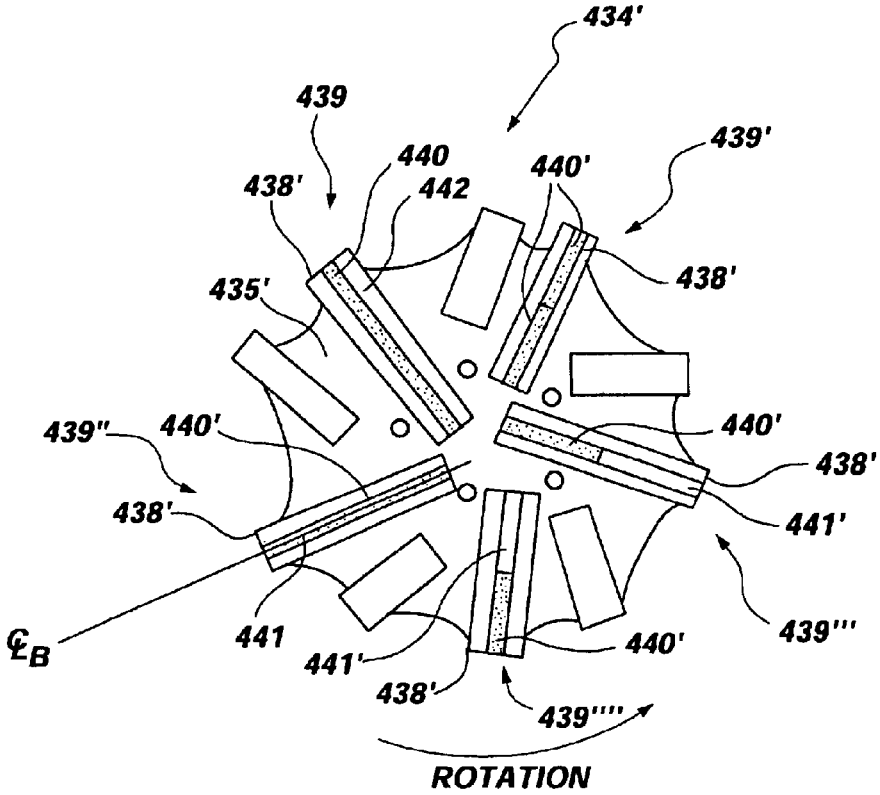
FIG. 43*a* is a bottom view of a drill bit embodying the present invention in which various generally rectangular segments are mounted on generally radially oriented cutting structures, or blades.

Blades 430 which have been designed not to extend radially inward as far as blades 412, 416, 418, and 426 can be provided with a laminated cutting element of any desired configuration such as with alternating superabrasive impregnated segments 431 and superabrasive-free segments 432 of any desired shape in accordance with the present invention. With respect to blade 430, it can be seen that blade 430 surrounds the leading edge and trailing edge of an exemplary cutting element having segments 431 and 432. By designing a laminated cutting element to be so captured by a blade, increased support and stiffness can be provided. During use, the blade would wear more quickly than superabrasive-free segment 432, which in turn would wear more quickly than superabrasive impregnated segment 431, thereby allowing the cutting surfaces of the segments to engage the formation while the less abrasive segment 432 would allow drilling fluid access to superabrasive impregnated segment 431 as discussed previously. It should be understood, all of the blades depicted in FIG. 41*a* are exemplary, and many other combinations and alternatively shaped and oriented cutting elements comprised of variously shaped segments can be utilized on a bladed-style drill bit in accordance with the present invention. Imaginary reference line $CL_B$ located along, or coincident, the major axis of a given blade provides a convenient way to reference the orientation of segments provided on such blade. As shown in FIG. 43*a* as well as other drawing figures, blades may be aligned to extend generally radially from the longitudinal center of a drill bit, or, as is often preferred, blades may be offset from the longitudinal center of a drill bit as shown for example in FIG. 43*a*. It should be appreciated, however, that blades need not necessarily be oriented to generally extend radially outward from the longitudinal axis of a drill bit, but could also extend generally circumferentially about the face of the drill bit with respect to the longitudinal axis of the drill bit.

Figure 42A:
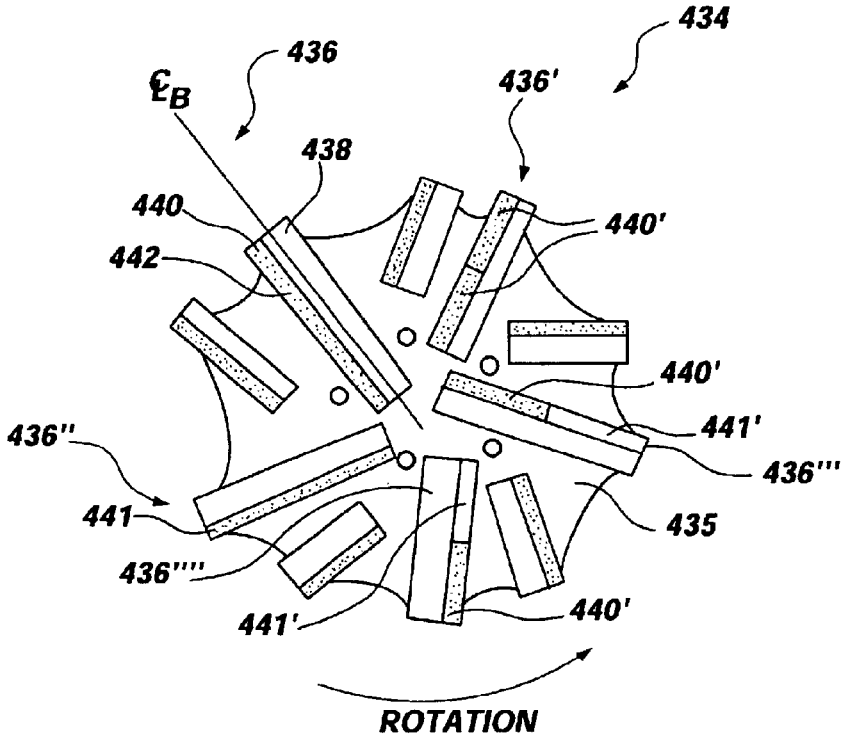
FIG. 42*a* is a bottom view of a drill bit embodying the present invention in which various generally rectangular segments are mounted on generally radially oriented cutting structures, or blades.
Figure 42B:
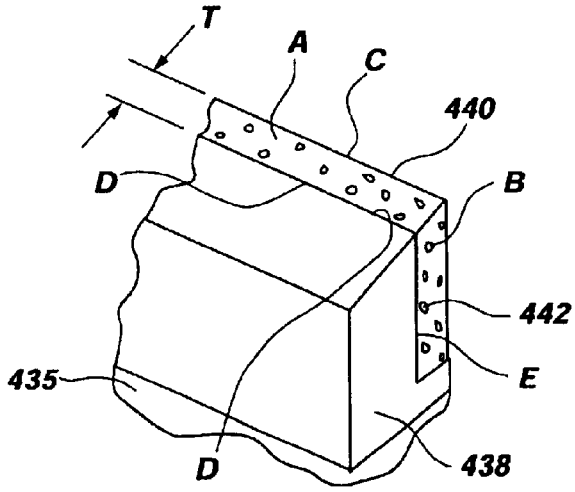
FIG. 42*b* is a broken-away perspective view of a portion of a representative cutting structure shown in FIG. 42*a;*

Another embodiment of the present invention is shown in FIGS. 42*a* and 42*b* of the drawings. Bladed style drill bit 434 is preferably provided with a plurality of blades of the same or differing radial lengths which originate on face 435. The conventional direction in which drill bit 434 is rotated is shown with face 435 being held facing upward while one looks downward thereon.

An exemplary superabrasive impregnated single segment 440 having superabrasive particles 442 dispersed preferably there throughout forming a cutting element 436 is shown being installed on the leading side of representative blade 438. Preferably, a drill bit would be provided with a plurality of such representative blades 438 having a cutting element 436 thereon. Optionally, as shown in the representative blade having cutting element 436', a plurality of superabrasive impregnated segments 440' can be provided on the leading side of the representative blade in an end-to-end manner to form cutting element 436' instead of having a single segment. A yet further option includes providing a superabrasive-free segment 441 as shown mounted on the leading side of a representative blade having cutting element 436" thereon. As with cutting element 436', a plurality of superabrasive-free segments could be provided in an end-to-end fashion. Preferably, a drill bit would be provided with a preselected number of blades having an alternating arrangement, or pattern, of cutting elements such as cutting elements 436' and 436". By providing a drill bit with blades having such an alternating cutting element arrangement, the formation would be engaged by a superabrasive impregnated segment-containing blade followed by a superabrasive-free segment-containing blade and so forth as the drill bit is rotated and the blades sweep across their respective paths.

Alternatively, a superabrasive-free segment 441' can be positioned and secured to the radially outermost portion of the leading side of a blade and a superabrasive impregnated segment 440' can be positioned and secured to the radially innermost portion of the leading side of the same blade in an end-to-end fashion with segment 441'. Such an alternating end-to-end segment arrangement is shown in cutting element 436'". Preferably, a cutting element on a proximate blade, such as cutting element 436"", would be provided with an inverse segment arrangement wherein a superabrasive-free segment 441' is positioned radially innermost and a superabrasive impregnated segment 440' is positioned radially outermost with the inverse arrangement repeating itself on other blades to be provided on a bit so that a bit so designed would have superabrasive impregnated segments followed by superabrasive-free segments sweeping across the entire face of the bit as it engages a formation and thereby prevent unwanted kerfing as discussed previously herein.

By virtue of representative cutting elements 436, 436', 436", 436'" and 436"" having at least one superabrasive impregnated segment in accordance with the present invention offered is a cutting element arrangement in which the relatively narrow cross-sectional thickness T, as shown in FIG. 42*b* and as previously discussed as preferably being approximately ⅛ inch (approximately 3 mm), allows cutting surfaces A and B of segment 440 to be better flushed with water or drilling fluid to remove formation fines and rock flour when encountering hard formations. Thus, segments 440, segments 440', 441, and/or segments 441' provide a small footprint with respect to exposed cutting surface A oriented in the same direction as face 435 and with respect to surface B oriented in the same general direction as the gage of a drill bit but offers the benefit of a large surface C to provide enhanced cutting ability and wear resistance in both soft and hard formations. Furthermore, the large back surface D of segment 440 and backing surface E of blade 438 provides substantial surface area in which segment 440 can be secured to blade 438 by processes known within the art and previously mentioned as compared to bladed-type drill bits incorporating priorly known impregnated cutting elements.

A yet further option includes substituting a plurality of segments such as segments 440' and 441' with composite-style segment 262 shown in FIG. 27. By using such segment 262, the alternating superabrasive impregnated segment/superabrasive-free segment arrangement could be achieved on alternating blades 436''' and 436'''', for example, by merely rotating segment 262 by 180° to orient and position the superabrasive impregnated portion 264 and the superabrasive-free portion 268 on respectively accommodating blades as desired. Thus, the present invention is not necessarily limited to drill bits having cutting elements comprised of at least one superabrasive-free segment with at least one superabrasive impregnated segment to form a cutting element having a preselected pattern or array.

Figure 43B:
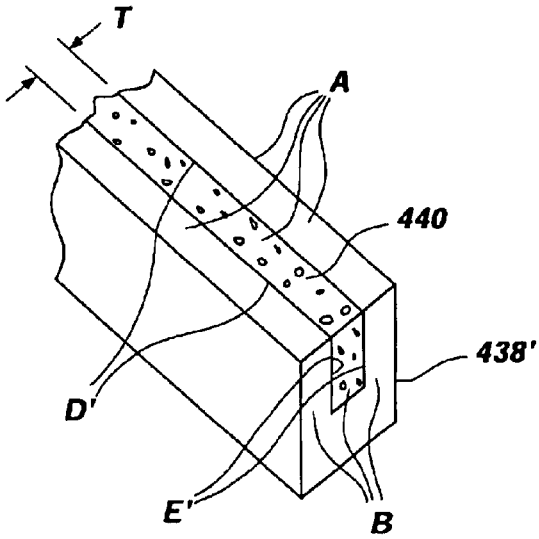
FIG. 43*b* is a broken-away perspective view of a portion of a representative cutting structure shown in FIG. 43*a;*

Referring to FIGS. 43*a* and 43*b* of the drawings, shown are yet further embodiments of the present invention as adapted to a representative bladed-style drill bit 434' similar to bladed-style drill bit 434 illustrated within FIG. 42*a*. An exemplary superabrasive impregnated single segment 440 having superabrasive particles 442 dispersed preferably throughout forming a cutting element 439 is shown being installed generally along the centerline of representative blade 438' and thereby generally cradled by blade 438'. Preferably, drill bit 434' shown in FIG. 43*a* would be provided with a plurality of such representative blades 438' having a cutting element 439 thereon.

Optionally, as shown in the representative blade having cutting element 439' thereon, a plurality of superabrasive impregnated segments 440' can be provided generally along the centerline of the representative blade in an end-to-end manner to form cutting element 439' in lieu of having a single segment cradled within the blade. A yet further option includes providing a superabrasive-free segment 441 as shown mounted generally along the centerline of a representative blade having cutting element 439" thereon. As with cutting element 439', a plurality of superabrasive-free segments could be provided in an end-to-end fashion if desired (not shown). Preferably a drill bit would be provided with a preselected number of blades having an alternating arrangement, or pattern, of cutting elements such as cutting elements 439 and 439". By providing a drill bit with blades having such an alternating cutting element arrangement, the formation would be engaged by a superabrasive impregnated segment-containing blade followed by a superabrasive-free segment-containing blade and so forth as the drill bit is rotated and the blades sweep across their respective paths.

Alternatively, a superabrasive-free segment 441' can be positioned and secured to the radially outermost portion of the leading side of a blade and a superabrasive impregnated segment 440' can be positioned and secured to the radially innermost portion and generally along the center of the same blade in an end-to-end fashion with segment 441'. Such an alternating end-to-end segment arrangement is shown in cutting element 439'''. Preferably, a cutting element on a proximate blade, such as cutting element 439'''', would be provided with an inverse segment arrangement wherein a superabrasive-free segment 441' is positioned radially innermost and a superabrasive impregnated segment 440' is positioned radially outermost with the inverse arrangement repeating itself on other blades to be provided on a bit so that a bit so designed would have superabrasive impregnated segments followed by superabrasive-free segments sweeping across the entire face of the bit as it engages a formation and thereby prevent unwanted kerfing as discussed previously herein.

As with the cutting elements shown in FIG. 42*a*, representative cutting elements 439, 439', 439", 439''' and 439'''' shown in FIG. 43*a* have at least one segment cradled by a respectively accommodating blade 438' in accordance with the present invention. This offers a cutting element arrangement in which the relatively narrow cross-sectional thickness T of segment 440, for example, as shown in FIG. 43*b* and as previously discussed as preferably being approximately ⅛ inch (approximately 3 mm), allows cutting surfaces A and B of segment 440 and the upright portions of blade 438' to be better flushed with water or drilling fluid to remove formation fines and rock flour when encountering hard formations. Thus, segments 440, segments 440', 441, and/or segments 441' when installed provide a small footprint with respect to exposed cutting surface A oriented in the same direction as face 435' and with respect to surface B oriented in the same general direction as the gage of a drill bit but the cradling nature of blade 438' provides enhanced structural support of a segment so installed to keep it from prematurely fracturing or being altogether displaced from blade 438'. Furthermore, the large back surfaces D' of segment 440 and backing surfaces E' of blade 438' provide yet even more substantial surface area in which segment 440 can be secured to blade 438' by processes known within the art and previously mentioned as compared to bladed-type drill bits incorporating priorly known impregnated cutting elements.

Figure 44:
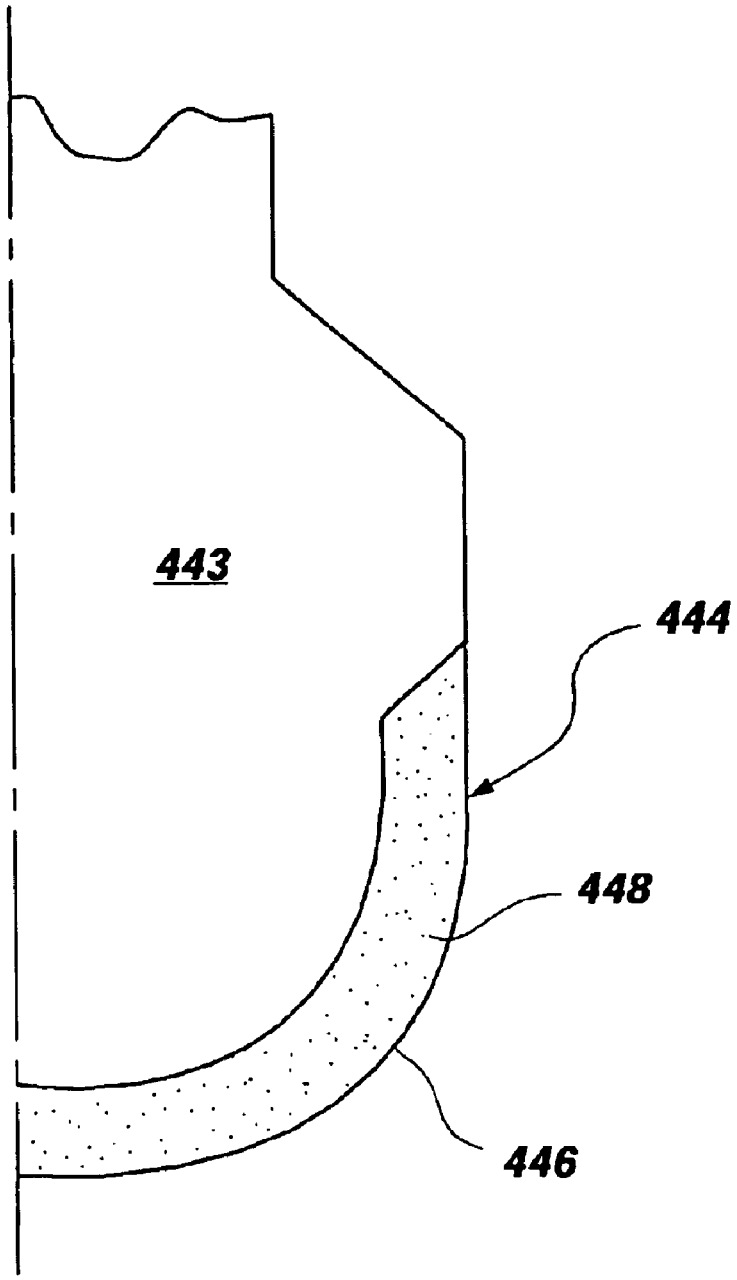
FIG. 44 is a broken-away cross-sectional view of a drill bit having a single, superabrasive impregnated segment mounted on a cutting structure thereof.

A partial front view of drill bit 443 shown in FIG. 44 illustrates a single, superabrasive impregnated segment 446 having superabrasive particles 448 dispersed generally there throughout mounted along the crown 444 of drill bit 443. Although, segment 446 is shown as being a single continuous segment, multiple contiguous segments could also be provided in accordance with the present invention.

Figure 45C:
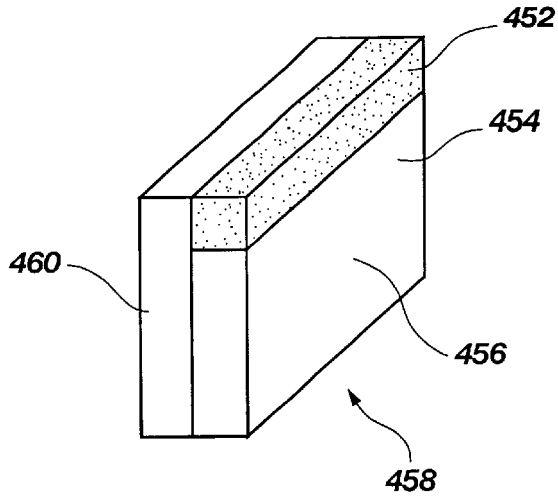
FIGS. 45*a*–45*c* are perspective views of a PDC cylindrical cutting element which can be sectioned to provide a PDC substrate to be used in combination with a segment formed of a solid matrix material to construct a laminated cutting element in accordance with the present invention.
Figure 45A:
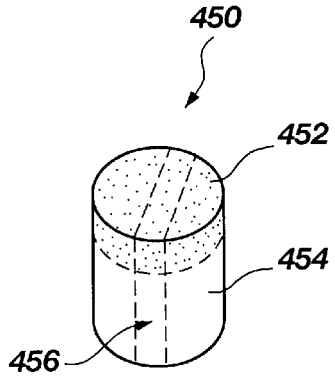
Figure 45B:
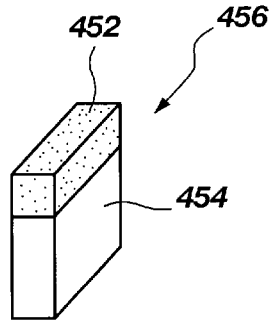

FIGS. 45*a*–45*c* illustrate an alternative embodiment of the present invention wherein a suitable superabrasive-containing segment 456 is sectioned out of the center portion of a priorly known cylindrically shaped cutting element, or button, 450. Diamond or PDC buttons 450 typically have a diamond or PDC table 452 securely attached to a metal matrix substrate 454 and are readily commercially available. A generally rectangular superabrasive-containing segment 456 may be sectioned out of a button 450 by known machining techniques such as electrical discharge machining and known superabrasive sawing techniques. After segment 456 having a superabrasive table 452 is removed from a selected button, segment 456 can then be combined with a superabrasive-free metal matrix segment 460 having the requisite qualities and characteristics previously discussed herein to provide a laminated cutting element 458. Laminated cutting element 458, with or without additional superabrasive-containing segments and/or superabrasive-free segments being combined to form a preselected pattern or laminate, can then be installed or formed in situ on drill bits in accordance with the present invention as previously discussed and illustrated. Consistent with alternative embodiments discussed and depicted herein, superabrasive-free metal matrix segment 460 can alternatively comprise superabrasive particles or abrasive particles that are actually or in effect less abrasive and less abrasion resistant than superabrasive table 452 incorporated within segment 456.

Another example of a laminated cutting element in accordance with the present invention can be mounted upon a support member fabricated from a tough, ductile material, as discussed above, which is in turn secured to a preselected position upon a drill bit. For example, a single, superabrasive impregnated segment such as previously described superabrasive impregnated segment 250 could serve as superabrasive impregnated segment 148 of cutting element 140 mounted on support member 142 which is secured within socket 147 in the face of drill bit 146 as shown in FIG. 16.

Figure 46:
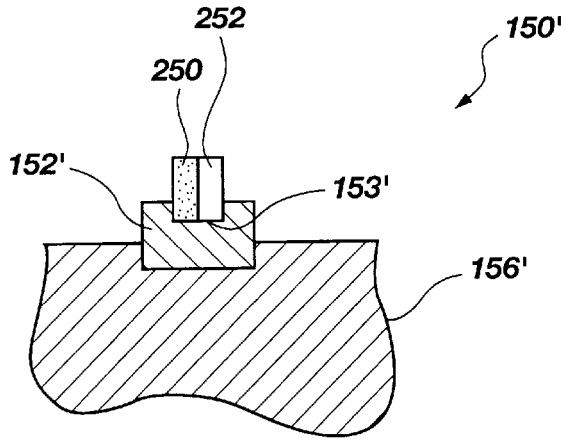
FIG. 46 is a cross-sectional view of an alternative to the cutting element originally shown in FIG. 17.

Another alternative in which at least one superabrasive impregnated segment 250 is juxtapositioned with at least one superabrasive-free segment 252 is shown in FIG. 46 in the form of cutting structure 150'. Segments 250 and 252 are secured and retained within recess 153' of support member 152', in a manner as previously described. Preferably, segments 250 and 252 are positioned in the side-by-side manner shown in FIG. 46 and are preferably oriented so that superabrasive impregnated segment 250, upon support member 152' being installed upon the bit body of a drill bit 156', would lead superabrasive-free segment 252. That is, segment 250 would be the first segment to engage the formation being drilled followed by segment 252 as the drill bit is rotated during the drilling process. By orienting the segments in such a lead/follow orientation, drilling fluid will have better access to the cutting surface of superabrasive impregnated segment 250 while also providing backing support to superabrasive impregnated segment 250. As with the various cutting elements described and illustrated herein, a plurality of segments 250 and 252 can be arranged in a variety of patterns and orientations and retained within a recess 153' of a support member 152'. Alternatively, superabrasive-free segment 252 can be provided with secondary less abrasive, less wear resistant superabrasive or abrasive particles than the particulate superabrasive material impregnated within primary superabrasive impregnated segments 250.

As with all of the exemplary cutting elements depicted within the drawings, a large variety of particularly shaped segments arranged in a large variety of patterns, or arrays, to form various laminated cutting elements in accordance with the present invention will now be apparent to those skilled in the art.

Although the foregoing description contains many specifics, these should not be construed as limiting the scope of the present invention, but merely as providing illustrations of some of the presently preferred embodiments. Similarly, other embodiments of the invention may be devised which do not depart from the spirit or scope of the present invention. The scope of this invention is, therefore, indicated and limited only by the appended claims and their legal equivalents, rather than by the foregoing description. All additions, deletions and modifications to the invention as disclosed herein which fall within the meaning and scope of the claims are to be embraced thereby.

What is claimed is:

1. A rotary-type earth-boring drill bit for drilling subterranean formations, comprising:

a bladed-type bit body having at least one blade structure extending upwardly therefrom, the at least one blade structure having a major axis along which the at least one blade structure extends between a radially innermost end and a radially outermost end; and at least one preformed laminated cutting element installed on the at least one blade structure comprising at least one first segment juxtapositioned with at least one second segment;

the at least one first segment having a preselected overall configuration and being of a preselected nominal thickness, the at least one first segment comprised of an essentially continuous-phase solid matrix of at least one material impregnated with at least one particulate superabrasive material in at least a portion thereof;

the at least one second segment having a preselected overall configuration and being of a preselected nominal thickness, the at least one second segment comprised of a continuous-phase solid matrix material; and wherein the at least one first segment and the at least one second segment of the at least one preformed laminated cutting element extend substantially coextensively along the major axis of the at least one blade structure substantially between the radially innermost end and the radially outermost end thereof.

2. The drill bit of claim 1, wherein at least one of the at least one first and at least one second segments is comprised of a continuous-phase solid matrix material comprising at least one of the group consisting of a metal carbide, tungsten carbide, a tungsten-based alloy, a refractory metal alloy, a ceramic, copper, a copper-based alloy, nickel, a nickel-based alloy, cobalt, a cobalt-based alloy, iron, an iron-based alloy, silver, and a silver-based alloy.

3. The drill bit of claim 1, wherein the at least one particulate superabrasive material of the at least one first segment comprises at least one of the group consisting of natural diamond, synthetic diamond, polycrystalline diamond compact, thermally stable polycrystalline diamond, and cubic boron nitride.

4. The drill bit of claim 1, wherein the at least one particulate superabrasive material of the at least one first segment is dispersed essentially throughout the at least one first segment.

5. The drill bit of claim 1, wherein the at least one particulate superabrasive material of the at least one first segment is dispersed essentially throughout no more than approximately one half of the at least one first segment.

6. The drill bit of claim 1, wherein at least one of the at least one first and at least one second segments has a substantially nonuniform thickness.

7. The drill bit of claim 1, wherein the respective preselected overall configurations of the at least one first segment and the at least one second segment comprise at least one configuration selected from the group consisting of generally rectangular, generally arcuate, generally circular, generally semicircular, and generally serpentine.

8. The drill bit of claim 1, wherein:

the at least one first segment and the at least one second segment comprise a plurality of first segments and a plurality of second segments having essentially the same preselected overall configuration, each of the segments of the first and second pluralities of segments has a cross-section of generally the same nominal thickness and each of the segments of the first and second pluralities of segments has a preselected edge facing outwardly from the bit body.

9. The drill bit of claim 1, wherein the at least one preformed laminated cutting element is located along at least a portion of a leading side of the at least one blade structure.

10. The drill bit of claim 9, wherein the at least one preformed laminated cutting element is at least partially recessed within the at least one blade structure and along at least a portion of the leading side of the at least one blade structure.

11. The drill bit of claims 1, wherein the at least one first segment and the at least one second segment are generally centered along the major axis of the at least one blade structure.

12. The drill bit of claim 11, wherein the at least one preformed laminated cutting element is at least partially recessed within the at least one blade structure.

13. The drill bit of claim 1, wherein at least a portion of the at least one second segment is impregnated with at least one particulate superabrasive material and wherein the at least one first segment is more abrasive than the at least one second segment.

14. The drill bit of claim 13, wherein the at least one first segment comprises thermally stable polycrystalline diamond and the at least one second segment comprises natural diamond.

15. The drill bit of claim 1, wherein the at least one particulate superabrasive material of the at least one first segment is generally located within a plurality of particulate superabrasive cylinders, the plurality of particulate superabrasive cylinders oriented and arranged in a preselected pattern within the at least one first segment.

16. The drill bit of claim 15, wherein the plurality of particulate superabrasive cylinders is oriented to be generally perpendicular to a preselected cutting surface of the at least one preformed laminated cutting element.

17. The drill bit of claim 1, wherein a rotationally leading portion of the at least one preformed laminated cutting element is exposed.

18. A rotary-type earth-boring drill bit for drilling subterranean formations, comprising:

a bit body having a longitudinal centerline, an end face region, and a peripheral gage region;

at least one preformed laminated cutting element installed on at least a portion of the end face region of the bit body and extending generally radially outward toward the peripheral gage region of the bit body, the at least one preformed laminated cutting element comprising:

at least one first segment having a preselected overall configuration, having a preselected nominal thickness, and being comprised of an essentially continuous-phase solid matrix of at least one material impregnated with at least one particulate superabrasive material in at least a portion thereof; and at least one second segment having a preselected overall configuration, having a preselected nominal thickness, and being comprised of an essentially continuous-phase solid matrix;

the at least one first segment and the at least one second segment being generally radially juxtapositioned in contact with each other in a preselected alternating fashion in partial mutual radial overlapping relationship and oriented at an acute angle with respect to an imaginary reference line extending from the longitudinal centerline of the bit body outwardly toward the peripheral gage region of the bit body and wherein a rotationally leading portion of the at least one preformed laminated cutting element is exposed.

19. The drill bit of claim 18, wherein at least one of the at least one first and at least one second segments is comprised of a continuous-phase solid matrix material comprising at least one of the group consisting of a metal carbide, tungsten carbide, a tungsten-based alloy, a refractory metal alloy, a ceramic, copper, a copper-based alloy, nickel, a nickel-based alloy, cobalt, a cobalt-based alloy, iron, an iron-based alloy, silver, and a silver-based alloy.

20. The drill bit of claim 18, wherein the at least one particulate superabrasive material of the at least one first segment comprises at least one of the group consisting of natural diamond, synthetic diamond, polycrystalline diamond compact, thermally stable polycrystalline diamond, and cubic boron nitride.

21. The drill bit of claim 18, wherein the at least one particulate superabrasive material of the at least one first segment is dispersed essentially throughout the at least one first segment.

22. The drill bit of claim 18, wherein the at least one particulate superabrasive material of the at least one first segment is dispersed essentially throughout no more than approximately one half of the at least one first segment.

23. The drill bit of claim 18, wherein at least one of the at least one first and at least one second segments has a substantially nonuniform thickness.

24. The drill bit of claim 18, wherein the respective preselected overall configurations of the at least one first segment and the at least one second segment comprise at least one configuration selected from the group consisting of generally rectangular, generally arcuate, and generally serpentine.

25. The drill bit of claim 18, wherein:

the at least one first segment and the at least one second segment comprise a plurality of the first segments and a plurality of the second segments having essentially the same preselected overall configuration;

each of the segments of the first and second pluralities of segments has a cross-section of generally equal nominal thickness;

each segment of the first and second plurality of segments has a preselected edge facing outwardly from the bit body; and each segment of the first and second plurality of segments partially radially overlaps and extends beyond the next most inward segment along the imaginary reference line.

26. The drill bit of claim 25, wherein each of the segments of the first and second pluralities of segments has a nonconstant cross-sectional thickness comprising a minimum thickness and a maximum thickness.

27. The drill bit of claim 18, wherein at least a portion of the at least one second segment is impregnated with at least one particulate superabrasive material and wherein the at least one first segment is more abrasive than the at least one second segment.

28. The drill bit of claim 27, wherein the at least one first segment comprises thermally stable polycrystalline diamond and the at least one second segment comprises natural diamond.

29. The drill bit of claim 18, wherein the at least one particulate superabrasive material of the at least one first segment is generally located within a plurality of particulate superabrasive cylinders, the plurality of particulate superabrasive cylinders oriented and arranged in a preselected pattern within the at least one first segment.

30. The drill bit of claim 29, wherein the plurality of particulate superabrasive cylinders is oriented to be generally perpendicular to a preselected cutting surface of the at least one preformed laminated cutting element.

31. A rotary-type earth-boring drill bit for drilling subterranean formations, comprising:

a bladed-type bit body having at least one blade structure extending therefrom; and a cutting element installed on the at least one blade structure;

the cutting element comprising at least one first segment having a preselected overall configuration and being of a preselected nominal thickness secured to the at least one blade structure of the bit body, the at least one first segment comprised of an essentially continuous-phase solid matrix of at least one material impregnated with at least one particulate superabrasive material in at least a portion thereof;

the at least one first segment being disposed lengthwise on the at least one blade structure to expose at least one lengthwise-extending edge of the at least one first segment; and the at least one first segment being located at a preselected distance from and at a preselected orientation with respect to an imaginary reference line extending generally coincident to a major axis of the at least one blade structure;

the cutting element further comprising at least one second segment comprised of an essentially continuous-phase solid matrix of at least one material, the at least one second segment having essentially the same preselected overall configuration as the at least one first segment, having a cross-section of essentially the same nominal thickness as the at least one first segment, having an exposed lengthwise edge, and being positioned in an end-to-end arrangement with respect to the at least one first segment.

32. The drill bit of claim 31, wherein at least one of the at least one first segment is comprised of a continuous-phase solid matrix material comprising at least one of the group consisting of a metal carbide, tungsten carbide, a tungsten-based alloy, a refractory metal alloy, a ceramic, copper, a copper-based alloy, nickel, a nickel-based alloy, cobalt, a cobalt-based alloy, iron, an iron-based alloy, silver, and a silver-based alloy.

33. The drill bit of claim 31, wherein the at least one particulate superabrasive material comprises at least one of the group consisting of natural diamond, synthetic diamond, polycrystalline diamond compact, thermally stable polycrystalline diamond, and cubic boron nitride.

34. The drill bit of claim 31, wherein the at least one particulate superabrasive material of the at least one first segment is dispersed essentially throughout the at least one first segment.

35. The drill bit of claim 31, wherein the at least one particulate superabrasive material of the at least one first segment is dispersed essentially throughout no more than approximately one half of the at least one first segment.

36. The drill bit of claim 31, wherein the preselected nominal thickness of the at least one first segment is less than approximately 0.5 inches (approximately 12.7 mm).

37. The drill bit of claim 31, wherein the preselected nominal thickness of the at least one first segment is less than approximately 0.25 inches (approximately 6.4 mm).

38. The drill bit of claim 31, wherein the preselected nominal thickness of the at least one first segment is less than approximately 0.15 inches (approximately 3.8 mm).

39. The drill bit of claim 31, wherein the preselected overall configuration of the at least one first segment is generally rectangular.

40. The drill bit of claim 31, wherein the at least one first segment has a substantially nonuniform thickness.

41. The drill bit of claim 31, wherein the cutting element is located along at least a portion of a leading side of the at least one blade structure.

42. The drill bit of claim 31, wherein the cutting element is at least partially recessed within and along at least a portion of a leading side of the at least one blade structure.

43. The drill bit of claim 31, wherein the cutting element is generally centered along the imaginary reference line.

44. The drill bit of claim 43, wherein the cutting element is at least partially recessed within the at least one blade structure.

45. The drill bit of claims 31, wherein at least a portion of the at least one second segment is impregnated with at least one particulate superabrasive material and wherein the at least one first segment is more abrasive than the at least one second segment.

46. A rotary-type earth-boring drill bit for drilling subterranean formations, comprising:

a bladed-type bit body having at least one blade structure extending upwardly therefrom, the at least one blade structure having a major axis along which the at least one blade structure extends between a radially innermost end and a radially outermost end; and at least one preformed laminated cutting element installed on the at least one blade structure comprising at least one first segment juxtapositioned with at least one second segment;

the at least one first segment having a preselected overall configuration and a length and being of a preselected nominal thickness, the at least one first segment comprised of an essentially continuous-phase solid matrix of at least one material impregnated with at least one particulate superabrasive material in at least a portion thereof;

the at least one second segment having a preselected overall configuration and a length and being of a preselected nominal thickness, the at least one second segment comprised of a continuous-phase solid matrix material; and wherein the at least one first segment and the at least one second segment of the at least one preformed laminated cutting element are each disposed in mutual, substantially parallel contact over a majority of their respective lengths, with their respective lengths at an acute angle to the major axis of the at least one blade structure and with ends thereof exposed on a rotationally leading edge of the at least one blade structure.

47. The drill bit of claim 46, wherein at least one of the at least one first and at least one second segments is comprised of a continuous-phase solid matrix material comprising at least one of the group consisting of a metal carbide, tungsten carbide, a tungsten-based alloy, a refractory metal alloy, a ceramic, copper, a copper-based alloy, nickel, a nickel-based alloy, cobalt, a cobalt-based alloy, iron, an iron-based alloy, silver, and a silver-based alloy.

48. The drill bit of claim 46, wherein the at least one particulate superabrasive material of the at least one first segment comprises at least one of the group consisting of natural diamond, synthetic diamond, polycrystalline diamond compact, thermally stable polycrystalline diamond, and cubic boron nitride.

49. The drill bit of claim 46, wherein at least one of the at least one first and at least one second segments has a substantially nonuniform thickness.

50. The drill bit of claim 46, wherein the respective preselected overall configurations of the at least one first segment and the at least one second segment comprise at least one configuration selected from the group consisting of generally rectangular, generally arcuate, generally circular, generally semicircular, and generally serpentine.

51. The drill bit of claim 46, wherein:

the at least one first segment and the at least one second segment comprise a plurality of first segments and a plurality of second segments having essentially the same preselected overall configuration, each of the segments of the first and second pluralities of segments has a cross-section of generally the same nominal thickness and each of the segments of the first and second pluralities of segments has a preselected edge facing outwardly from the bit body.

52. The drill bit of claim 46, wherein the at least one preformed laminated cutting element is located along at least a portion of a leading side of the at least one blade structure.

53. The drill bit of claim 52, wherein the at least one preformed laminated cutting element is at least partially recessed within the at least one blade structure and along at least a portion of the leading side of the at least one blade structure.

54. The drill bit of claim 46, wherein at least a portion of the at least one second segment is impregnated with at least one particulate superabrasive material and wherein the at least one first segment is more abrasive than the at least one second segment.

55. The drill bit of claim 54, wherein the at least one first segment comprises thermally stable polycrystalline diamond and the at least one second segment comprises natural diamond.

56. The drill bit of claim 46, wherein the at least one particulate superabrasive material of the at least one first segment is generally located within a plurality of particulate superabrasive cylinders, the plurality of particulate superabrasive cylinders oriented and arranged in a preselected pattern within the at least one first segment.

57. The drill bit of claim 56, wherein the plurality of particulate superabrasive cylinders is oriented to be generally perpendicular to a preselected cutting surface of the at least one preformed laminated cutting element.

58. A rotary-type earth-boring drill bit for drilling subterranean formations, comprising:

a bit body having a longitudinal centerline, an end face region, and a peripheral gage region;

at least one preformed laminated cutting element installed on at least a portion of the end face region of the bit body, the at least one preformed laminated cutting element comprising:

at least one first segment having a preselected overall configuration, having a preselected nominal thickness, and being comprised of an essentially continuous-phase solid matrix of at least one material impregnated with at least one particulate superabrasive material in at least a portion thereof; and at least one second segment having a preselected overall configuration, having a preselected nominal thickness, and being comprised of an essentially continuous-phase solid matrix;

the at least one first segment and the at least one second segment being generally radially juxtapositioned with each other in a preselected alternating fashion, the at least one first segment and the at least one second segment each being generally arcuate in configuration and oriented generally circumferentially about the longitudinal centerline of the bit body.

59. The drill bit of claim 58, wherein a rotationally leading portion of the at least one preformed laminated cutting element is exposed.

60. The drill bit of claim 58, wherein at least one of the at least one first and at least one second segments is comprised of a continuous-phase solid matrix material comprising at least one of the group consisting of a metal carbide, tungsten carbide, a tungsten-based alloy, a refractory metal alloy, a ceramic, copper, a copper-based alloy, nickel, a nickel-based alloy, cobalt, a cobalt-based alloy, iron, an iron-based alloy, silver, and a silver-based alloy.

61. The drill bit of claim 58, wherein the at least one particulate superabrasive material of the at least one first segment comprises at least one of the group consisting of natural diamond, synthetic diamond, polycrystalline diamond compact, thermally stable polycrystalline diamond, and cubic boron nitride.

62. The drill bit of claim 58, wherein:

the at least one first segment and the at least one second segment comprise a plurality of the first segments and a plurality of the second segments having essentially the same preselected overall configuration;

each of the segments of the first and second pluralities of segments has a cross-section of generally equal nominal thickness; and each segment of the first and second plurality of segments has a preselected edge facing outwardly from the bit body.

63. The drill bit of claim 62, wherein each of the segments of the first and second pluralities of segments has a non-constant cross-sectional thickness comprising a minimum thickness and a maximum thickness.

64. The drill bit of claim 62, wherein each of the segments of the first and second pluralities of segments has substantially the same circumferential extent.

65. The drill bit of claim 62, wherein each of the segments of the first and second pluralities of segments has a greater circumferential extent than the next radially inwardly adjacent segment.

66. The drill bit of claim 58, wherein at least a portion of the at least one second segment is impregnated with at least one particulate superabrasive material and wherein the at least one first segment is more abrasive than the at least one second segment.

67. The drill bit of claim 66, wherein the at least one first segment comprises thermally stable polycrystalline diamond and the at least one second segment comprises natural diamond.

68. The drill bit of claim 58, wherein the at least one particulate superabrasive material of the at least one first segment is generally located within a plurality of particulate superabrasive cylinders, the plurality of particulate superabrasive cylinders oriented and arranged in a preselected pattern within the at least one first segment.

69. The drill bit of claim 68, wherein the plurality of particulate superabrasive cylinders is oriented to be generally perpendicular to a preselected cutting surface of the at least one preformed laminated cutting element.

70. A rotary-type earth-boring drill bit for drilling subterranean formations, comprising:

a bit body having a longitudinal centerline, an end face region, and a peripheral gage region;

at least one preformed laminated cutting element installed on at least a portion of the end face region of the bit body, the at least one preformed laminated cutting element comprising:

a plurality of first segments each having a preselected overall configuration, having a preselected nominal thickness, and being comprised of an essentially continuous-phase solid matrix of at least one material impregnated with at least one particulate superabrasive material in at least a portion thereof; and a plurality of second segments each having a preselected overall configuration, having a preselected nominal thickness, and being comprised of an essentially continuous-phase solid matrix;

the plurality of first segments and the plurality of second segments being generally juxtapositioned with each other in a preselected alternating fashion wherein each segment of one of the first and second pluralities of segments has at least one segment of the other of the first and second pluralities of segments in contact with a side thereof and at least another segment of the other of the first and second pluralities of segments in contact with an end thereof.

71. The drill bit of claim 70, wherein a rotationally leading portion of the at least one preformed laminated cutting element is exposed.

72. The drill bit of claim 70, wherein at least one of the at least one first and at least one second pluralities of segments is comprised of a continuous-phase solid matrix material comprising at least one of the group consisting of a metal carbide, tungsten carbide, a tungsten-based alloy, a refractory metal alloy, a ceramic, copper, a copper-based alloy, nickel, a nickel-based alloy, cobalt, a cobalt-based alloy, iron, an iron-based alloy, silver, and a silver-based alloy.

73. The drill bit of claim 70, wherein the at least one particulate superabrasive material of the plurality of first segments comprises at least one of the group consisting of natural diamond, synthetic diamond, polycrystalline diamond compact, thermally stable polycrystalline diamond, and cubic boron nitride.

74. The drill bit of claim 73, wherein each of the segments of the first and second pluralities of segments has a non-constant cross-sectional thickness comprising a minimum thickness and a maximum thickness.

75. The drill bit of claim 70, wherein at least a portion of the plurality of second segments is impregnated with at least one particulate superabrasive material and wherein the plurality of first segments is more abrasive than the plurality of second segments.

76. The drill bit of claim 70, wherein the plurality of first segments comprises thermally stable polycrystalline diamond and the plurality of second segments comprises natural diamond.

77. The drill bit of claim 70, wherein the at least one particulate superabrasive material of the plurality of first segments is generally located within a plurality of particulate superabrasive cylinders, the plurality of particulate superabrasive cylinders oriented and arranged in a preselected pattern within the plurality of first segments.

78. The drill bit of claim 77, wherein the plurality of particulate superabrasive cylinders is oriented to be generally perpendicular to a preselected cutting surface of the at least one preformed laminated cutting element.

79. The drill bit of claim 78, wherein the at least one preformed laminated cutting element extends generally outwardly from the longitudinal axis of the bit body toward the peripheral gage region.

80. The drill bit of claim 79, wherein the at least one preformed laminated cutting element extends substantially radially outwardly from the longitudinal axis of the bit body toward the peripheral gage region.

81. The drill bit of claim 79, wherein the at least one performed laminated cutting element is mounted to a blade structure disposed over the end face region.

82. The drill bit of claim 78, wherein the at least one preformed laminated cutting element is generally arcuate in configuration and oriented to extend substantially circumferentially about the longitudinal centerline of the bit body.

83. A rotary-type earth-boring drill bit for drilling subterranean formations, comprising:

a bit body having a longitudinal centerline, an end face region, and a peripheral gage region;

at least one preformed arcuate laminated cutting element installed on at least a portion of the end face region of the bit body, the at least one preformed, arcuate laminated cutting element comprising:

a plurality of first segments having a preselected overall configuration, having a preselected nominal thickness, and being comprised of an essentially continuous-phase solid matrix of at least one material impregnated with at least one particulate superabrasive material in at least a portion thereof; and a plurality of second segments having a preselected overall configuration, having a preselected nominal thickness, and being comprised of an essentially continuous-phase solid matrix;

the pluralities of first and second segments being generally circumferentially juxtapositioned in contact with each other in a preselected alternating fashion about the longitudinal centerline of the bit body.

84. The drill bit of claim 83, wherein a rotationally leading portion of the at least one preformed, arcuate laminated cutting element is exposed.

85. The drill bit of claim 83, wherein at least one of the pluralities of first and second segments is comprised of a continuous-phase solid matrix material comprising at least one of the group consisting of a metal carbide, tungsten carbide, a tungsten-based alloy, a refractory metal alloy, a ceramic, copper, a copper-based alloy, nickel, a nickel-based alloy, cobalt, a cobalt-based alloy, iron, an iron-based alloy, silver, and a silver-based alloy.

86. The drill bit of claim 83, wherein the at least one particulate superabrasive material of the plurality of first segments comprises at least one of the group consisting of natural diamond, synthetic diamond, polycrystalline diamond compact, thermally stable polycrystalline diamond, and cubic boron nitride.

87. The drill bit of claim 83, wherein:

the plurality of first segments and the plurality of second segments comprise a plurality of first segments and a plurality of second segments having essentially the same preselected overall configuration;

each of the segments of the first and second pluralities of segments has a cross-section of generally equal nominal thickness; and each segment of the first and second pluralities of segments has a preselected edge facing outwardly from the bit body.

88. The drill bit of claim 87, wherein each of the segments of the first and second pluralities of segments has a non-constant cross-sectional thickness comprising a minimum thickness and a maximum thickness.

89. The drill bit of claim 87, wherein each of the segments of the first and second pluralities of segments has substantially the same circumferential extent.

90. The drill bit of claim 83, wherein at least a portion of the plurality of second segments is impregnated with at least one particulate superabrasive material and wherein the plurality of first segments is more abrasive than the plurality of second segments.

91. The drill bit of claim 90, wherein the plurality of first segments comprises thermally stable polycrystalline diamond and the plurality of second segments comprises natural diamond.

92. The drill bit of claim 83, wherein the at least one particulate superabrasive material of the plurality of first segments is generally located within a plurality of particulate superabrasive cylinders, the plurality of particulate superabrasive cylinders oriented and arranged in a preselected pattern within the plurality of first segments.

93. The drill bit of claim 92, wherein the plurality of particulate superabrasive cylinders is oriented to be generally perpendicular to a preselected cutting surface of the at least one preformed, arcuate laminated cutting element.

* * * * *